US010407925B2

(12) United States Patent
Baron et al.

(10) Patent No.: US 10,407,925 B2
(45) Date of Patent: Sep. 10, 2019

(54) METHOD OF INSTALLING A FORMWORK SUPPORT SYSTEM, FORMWORK SUPPORT SYSTEM AND LONGITUDINAL BEAM

(71) Applicant: DOKA GMBH, Amstetten (AT)

(72) Inventors: Christoph Baron, Hollenstein an der Ybbs (AT); Alexander Augustin, Amstetten (AT)

(73) Assignee: DOKA GMBH, Amstetten (AT)

( * ) Notice: Subject to any disclaimer, the term of this patent is extended or adjusted under 35 U.S.C. 154(b) by 0 days.

(21) Appl. No.: 16/031,623

(22) Filed: Jul. 10, 2018

(65) Prior Publication Data

US 2019/0010716 A1 Jan. 10, 2019

Related U.S. Application Data

(63) Continuation-in-part of application No. 15/645,201, filed on Jul. 10, 2017, now Pat. No. 10,053,875.

(51) Int. Cl.
*E04G 11/50* (2006.01)
*E04G 11/38* (2006.01)
(Continued)

(52) U.S. Cl.
CPC ..... *E04G 11/50* (2013.01); *E04G 11/48* (2013.01); *E04G 11/483* (2013.01);
(Continued)

(58) Field of Classification Search
CPC ..... E04G 11/38; E04G 11/50; E04G 11/52; Y10T 29/49826
(Continued)

(56) References Cited

U.S. PATENT DOCUMENTS 3,397,858 A 8/1968 Williams
3,430,910 A 3/1969 Bowden et al.
(Continued)

FOREIGN PATENT DOCUMENTS

DE 3316557 C1 10/1984
DE 9005901 U1 9/1990
(Continued)

OTHER PUBLICATIONS

Baron, C. et al., "Formwork Support System and Method of Installing a Formwork Support System," U.S. Appl. No. 15/645,439, filed Jul. 10, 2017, 40 pages.
(Continued)

*Primary Examiner* — Michael Safavi
(74) *Attorney, Agent, or Firm* — McCoy Russell LLP

(57) ABSTRACT

A method of installing a formwork support system, comprising the steps of:

a. arranging a first pair of support props having head members in an upright position,
b. connecting opposite ends of a first longitudinal beam to the head members of the first pair of support props,
c. arranging a second longitudinal beam in an interim mounting position by releasably connecting a first end of the second longitudinal beam to the first longitudinal beam, the second longitudinal beam freely projecting downwardly from the first end towards the second end, a stop element at the first end of the second longitudinal beam bearing against the first longitudinal beam, a hook element of the second longitudinal beam, in the interim mounting position, engaging a slot of the first longitudinal beam,
d. arranging the second longitudinal beam in a horizontal support position by lifting the second end of the second longitudinal beam.

8 Claims, 18 Drawing Sheets

(51) Int. Cl.
*E04G 11/48* (2006.01)
*E04G 25/06* (2006.01)
*E04B 5/16* (2006.01)

(52) U.S. Cl.
CPC ..... *E04G 11/486* (2013.01); *E04G 25/061* (2013.01); *E04G 25/065* (2013.01); *E04B 5/16* (2013.01)

(58) Field of Classification Search
USPC ..... 108/157.1, 147.19; 249/18; 248/357, 248/354.5, 354.6; 29/469, 428
See application file for complete search history.

(56) References Cited

U.S. PATENT DOCUMENTS

| | | | | |
|---|---|---|---|---|
| 3,445,084 | A | 5/1969 | Williams | |
| 3,784,151 | A | 1/1974 | Steele | |
| 6,176,463 | B1 | 1/2001 | Röck | |
| 6,189,854 | B1 | 2/2001 | Irurzun Saez De Maturana | |
| 7,992,836 | B2 * | 8/2011 | Schworer | E04G 11/38 249/19 |
| 8,262,056 | B2 | 9/2012 | Schwoerer | |
| 8,523,137 | B2 | 9/2013 | Schwörer | |
| 8,616,519 | B2 | 12/2013 | Bacon | |
| 2003/0012607 | A1 | 1/2003 | Coday et al. | |
| 2004/0075043 | A1 | 4/2004 | Arozena Bergaretxe | |
| 2005/0144886 | A1 | 7/2005 | Holawe | |
| 2007/0209297 | A1 | 9/2007 | Schwoerer | |
| 2009/0212195 | A1 | 8/2009 | Arocena Bergareche et al. | |
| 2009/0294627 | A1 | 12/2009 | Schwoerer | |
| 2010/0115860 | A1 | 5/2010 | Braun | |
| 2011/0214824 | A1 * | 9/2011 | Beristain | E04G 21/16 160/368.1 |
| 2015/0069664 | A1 * | 3/2015 | Ciuperca | B28B 7/0032 264/333 |

FOREIGN PATENT DOCUMENTS

| | | | | | |
|---|---|---|---|---|---|
| DE | 3921064 | A1 | | 1/1991 | |
| DE | 102015223762 | | * | 6/2017 | E04G 11/48 |
| DE | 102016204633 | | * | 9/2017 | E04G 11/38 |
| EP | 1398432 | | * | 3/2004 | E04G 11/38 |
| EP | 1617013 | A1 | | 1/2006 | |
| EP | 2952653 | A1 | | 12/2015 | |
| FR | 3017891 | A1 | | 8/2015 | |
| GB | 2100331 | A | | 12/1982 | |
| KR | 20090076813 | A | | 7/2009 | |
| WO | 2006100694 | A1 | | 9/2006 | |
| WO | WO-2007003364 | A1 | * | 1/2007 | E04G 11/52 |
| WO | 2016116532 | A1 | | 7/2016 | |
| WO | WO-2017162423 | A1 | * | 9/2017 | E04G 11/38 |

OTHER PUBLICATIONS

ISA European Patent Office, International Search Report and Written Opinion Issued in Application No. PCT/EP2018/068586, dated Oct. 18, 2018, WIPO, 13 pages.
ISA European Patent Office, Written Opinion of the International Preliminary Examining Authority Issued in Application No. PCT/EP2018/068596, dated Jul. 3, 2019, WIPO, 5 pages.
ISA European Patent Office, Written Opinion of the International Preliminary Examining Authority Issued in Application No. PCT/EP2018/068598, dated Jul. 3, 2019, WIPO, 6 pages.

* cited by examiner

METHOD OF INSTALLING A FORMWORK SUPPORT SYSTEM, FORMWORK SUPPORT SYSTEM AND LONGITUDINAL BEAM

CROSS REFERENCE TO RELATED APPLICATIONS

The present application is a Continuation-in-Part of U.S. application Ser. No. 15/645,201 entitled "FORMWORK SUPPORT SYSTEM AND FORMWORK SUPPORT PROP," filed on Jul. 10, 2017, the entire contents of which is hereby incorporated by reference in its entirety for all purposes.

TECHNICAL FIELD

The present disclosure relates to a method of installing a formwork support system.

The present disclosure further relates to a formwork support system and a longitudinal beam for installation in such formwork support system.

DESCRIPTION OF THE RELATED ART

Such formwork support systems are generally known in the art. One example thereof is disclosed in US 2003/0012607 A1. This shoring and decking system is used for constructing a great variety of concrete structures by supporting a formwork on which cement compositions are poured and then cured. The known system comprises a plurality of vertical legs or post shores with drophead devices mounted thereon. A number of ledgers are individually held and retained by two drophead devices. In transverse direction, joist members connect to the ledgers. A number of sheets are placed over multiple ledgers and joist members.

It is an object of this present disclosure to improve the formwork support systems known in the prior art. The present disclosure particularly aims at improving safety and stability during shuttering and/or stripping of the formwork. It is also a goal of the present disclosure to facilitate the installation of the formwork support system.

SUMMARY OF THE PRESENT DISCLOSURE

In an embodiment, a method of installing a formwork support system comprises the steps of:

a. arranging a first pair of support props in an upright position, the support props having head members, b. connecting two opposite ends of a first longitudinal beam to the head members of the first pair of support props, c. arranging a second longitudinal beam in an interim mounting position by releasably connecting a first end of the second longitudinal beam to the first longitudinal beam, the second longitudinal beam, in the interim mounting position, freely projecting downwardly from the first end towards the second end, a stop element at the first end of the second longitudinal beam, in the interim mounting position, bearing against the first longitudinal beam, a hook element of the second longitudinal beam, in the interim mounting position, engaging a slot of the first longitudinal beam, d. arranging the second longitudinal beam in a horizontal support position by lifting the second end of the second longitudinal beam.

In an embodiment, a formwork support system comprises:

a first pair of support props arranged in an upright position, the support props having head members, a first longitudinal beam having opposite ends connected to the head members of the first pair of support props, the first longitudinal beam having a slot, a second longitudinal beam connected to the first longitudinal element, the second longitudinal element having, at its first end, a stop element and a hook element, wherein the second longitudinal beam, in an interim mounting position, freely projects downwardly from the first end towards the second end, wherein, in the interim mounting position, the stop element of the second longitudinal beam bears against the first longitudinal beam and the hook element engages the slot of the first longitudinal beam.

In an embodiment, a longitudinal beam for installation in a formwork support system comprises:

a first end and a second end, a slot, and at its first end, a stop element and a hook element for connection with a slot of another longitudinal beam.

Thus, the arrangement of the second longitudinal beam, in the inclined interim mounting position, is self-supporting by means of the stop element and the hook element. On the other hand, the second longitudinal beam may be lifted into a horizontal support position in which the hook element is released from the engagement with the slot of the first longitudinal beam so that the second longitudinal beam may be simply removed the formwork support system, for example by lifting the second longitudinal beam e.g. with a crane. In the horizontal support position, the second longitudinal beam extends transversely to the first longitudinal beam.

In an embodiment, the longitudinal beams each comprise a main section extending between the ends, at least the main sections of the longitudinal beams having top sides being arranged flush with the upper sides of support plates of the head members. Thus, the upper sides of the head members and the top sides of the main sections of the longitudinal beams constitute support surfaces for supporting a formwork, in particular a formwork sheet, thereon.

In an embodiment, a formwork support system is installed having at least one transverse beam extending transversely to the first longitudinal beam and in parallel to the second longitudinal beam, the longitudinal and transverse beams being arranged at the same vertical level (i.e. not on top of one another) so that one single horizontal array of longitudinal and transverse beams for support of the formworks is provided.

In an embodiment, a formwork support system comprises:

four support props, each having a leg and a head member mounted on an upper end of the leg, the head members each having a support plate with an upper side for supporting a formwork thereon, two longitudinal beams with ends attached to the head members of the support props, a transverse beam extending transversely to the longitudinal beams, wherein at least one of the head members has at least one recess formed in the support plate, an edge portion of one of the ends of one of the longitudinal beams being arranged in the recess and wherein the edge portion of the longitudinal beam snugly fits into the recess of the support plate of the head member.

For the purpose of this disclosure, all directions and positions, such as "upwards", "downwards", "upper", "lower" etc., are given with respect to a casting position of the formwork support system in general and the longitudinal beams and the transverse beams in specific. In the casting position the support props are arranged vertically and the longitudinal and transverse beams are arranged horizontally to form a horizontal concrete slab on top of the formworks. However, it is of course possible, for example, to pour and form inclined concrete slabs by adjusting the lengths of the support props accordingly. Furthermore, at some instances this disclosure refers to interim positions during shuttering for preparation of a casting step and/or stripping of the formwork after completion of the casting step.

In this embodiment, the arrangement of the edge portion of the longitudinal beam inside the recess of the head member of the support prop prevents tilting of the longitudinal beam with respect to its longitudinal axis. This greatly improves safety in the assembly and use of the formwork support system. In particular, the form-fit between the longitudinal beam and the head member below the formwork ensures that the formwork, which may be formed by formwork sheets (panels), may be safely stripped after completion of the pouring process and hardening of the poured concrete, without danger of the longitudinal beam falling off. The recess of the head member formed in the support plate further allows the longitudinal beam to be easily removed by simply lifting the longitudinal beam in an upward direction to be disengaged from the recess of the head member. Mounting or connecting the longitudinal beam to the head member may be done correspondingly.

The at least one recess may be elongated in a horizontal direction perpendicular to the longitudinal axis of the longitudinal beam. Moreover, the at least one recess preferably is rectangular in top view to accommodate a correspondingly shaped edge portion of the longitudinal beam. Also, the end of the longitudinal beam may vertically extend below a lower side of the support plate of the head member.

In an embodiment, the longitudinal beams each comprise a main section extending between the ends, at least the main section of the longitudinal beam connected to the recess of the head member having a top side being arranged flush with the upper side of the support plate of the head member. Thus, the upper side of the head member and the top side of the main section of the longitudinal beam constitute support surfaces for supporting a formwork, in particular a formwork sheet, thereon. Thus, the recess in the head member serves for laterally securing the longitudinal beam while maintaining the longitudinal beam flush with the support plate of the head member.

In an embodiment, the support plate comprises at least two recesses in two sides of the support plate. The longitudinal directions of the two recesses may extend perpendicularly to one another to secure one longitudinal beam and one transverse beam at the head member. Similarly, the longitudinal directions of the two recesses may extend parallel to one another to secure two longitudinal beams to the head member.

In an embodiment, the support plate comprises four recesses in four sides of the support plate. This embodiment is used at a crossing point of the formwork support system for securing two longitudinal beams parallel to one another in a longitudinal direction of the formwork support system and two transverse beams parallel to one another in a transverse direction of the formwork support system.

In an embodiment, the four recesses are formed on the four sides of a square section of the support plate. The support plate may have four ear portions at either corner of the support plate for forming the four recesses therebetween.

In an embodiment, the formwork support system comprises a support device for supporting one of the ends of the longitudinal beam on the head member, the support device comprising a pin and a groove. In this embodiment, the support device serves for vertically supporting the longitudinal beam on the head member while the form-fit between the recess of the head member and the edge portion of the longitudinal beam laterally supports the longitudinal beam.

In an embodiment, the pin is arranged on one of the ends of the longitudinal beam below the edge portion of the longitudinal beam and the groove is arranged on the head member below the support plate. In the assembly of the formwork support system, the longitudinal beam is mounted to the head members of two support props by lowering the pins on opposite ends of the longitudinal beam into correspondingly shaped grooves provided in the head members. At the same time, the edge portions of the longitudinal beam at its opposite ends are connected to the recesses of the head members. In this way, the longitudinal beam may be connected to the head members by lowering the longitudinal beam onto the head members.

In an embodiment, at least one of the longitudinal beams comprises at least one downwardly extending hook element and at least one of the longitudinal beams comprises at least one slot for accommodating the hook element. In this embodiment, two longitudinal beams may be connected to one another by insertion of the hook element of the one longitudinal beam into the slot of the other longitudinal beam. The hook element projects downwardly with respect to the horizontal casting position of the longitudinal beam.

In an embodiment, the longitudinal beam comprises two hook elements and a bracing connecting the two hook elements. This embodiment is particularly stable and may thus withstand high loads.

In an embodiment, at least one of the longitudinal beams comprises at least one downwardly extending stop element bearing against the head member in an inclined interim mounting position of the longitudinal beam in which the pin is arranged in the groove and the end of the longitudinal beam is arranged outside the recess of the support plate of the head member. In this way, the longitudinal beam can be held (without manual support) in the interim mounting (assembling) position by being suspended from the head member. Thus, connecting the longitudinal beam with the head member comprises the steps of:

a) arranging the pin on the one end of the longitudinal beam in the groove of the one head member while the longitudinal beam is arranged in a downwardly pointing interim mounting position with the stop element bearing against the head member, b) lifting the other end of the longitudinal beam to arrange the longitudinal beam in the horizontal final (casting) position.

In an embodiment, at least one head member comprises at least one upwardly extending holding element for holding the pin of the longitudinal beam when the support prop is brought from an inclined interim position to an upright support position. When assembling the formwork support system, the longitudinal beam may be lifted by means of the support prop from below, in particular from a ground on which the other support props are supported. The holding element prevents the support prop from being involuntarily released from the longitudinal beam when the support prop is lifted from its inclined interim position close to the ground to its upright (vertical) position thereby bringing the longitudinal beam connected to the support prop in its horizontal final position.

The upwardly projecting holding element may adjoin the groove for placing the pin therein. The holding element may have a hook at its free end.

In an embodiment, an end region of the transverse beam snugly fits in one of the recesses of the head member. In this way, the transverse beam may be protected against tilting with respect to its longitudinal axis when stripping the formwork.

In an embodiment, the transverse beam comprises a bolt and at least one of the head members comprises a channel for accommodating the bolt. The bolt and channel connection may be identical to the pin and groove connection explained above with respect to the attachment of the longitudinal beam to the head member.

In an embodiment, the transverse beam comprises a downwardly extending catch element for connection with a slot of at least one of the longitudinal beams. Thus, the transverse beam may be suspended between two neighboring longitudinal beams. The slot may extend in a longitudinal direction of the longitudinal beam at a lateral side thereof.

In an embodiment, the transverse beam comprises a first catch element at a first end region of the transverse beam and a second catch element at a second end region of the transverse beam, the first and second catch element being connected to the longitudinal beams, the first and second catch element being spaced apart in direction perpendicular to a longitudinal direction of the transverse beam. In this way, the transverse beam may be easily connected to two longitudinal beams in a sideward motion of the transverse beam.

In an embodiment, the transverse beam comprises a first abutment element at the first end region of the transverse beam and a second abutment element at the second end region of the transverse beam, the first and second abutment element each abutting on a top side of a flange of one of the longitudinal beams. In the assembled state (i.e. the support position), the abutment elements, which may have a level underside, are supported on the top sides of the flanges formed at the longitudinal sides of the longitudinal beams. The flanges may adjoin the slots for connection with the catch elements of the transverse beams.

The flange of the longitudinal beam may have an undercut. In this way, the undercut of the flange may be arranged for holding the hook element of the longitudinal beam in an inclined interim mounting position and for holding the catch element of the transverse beam in an inclined interim mounting position.

In an embodiment, the transverse beam comprises a first catch element and a first abutment element at a first end region of the transverse beam and a second catch element and a second abutment element at the second end region of the transverse beam, the first catch element at the first end region and the second abutment element at the second end region being arranged at the same horizontal position in direction perpendicular to the longitudinal direction of the transverse beam, the first abutment element at the first end region and the second catch element at the second end region being arranged at the same horizontal position in direction perpendicular to the longitudinal direction of the transverse beam. Thus, either end of the transverse beam has a catch element for engaging the slot and an abutment element for vertical support on the flange of the longitudinal beam. Due to the interchanged position of the catch and abutment elements on either side of the transverse beam, the attachment of the transverse beam to the longitudinal beams is particularly simple by turning or tilting the transverse beam in a horizontal plane between the longitudinal beams. On the other hand, the abutment elements ensure a stable support on the longitudinal beams.

In an embodiment, the transverse beam comprises a shoulder which extends horizontally below a lateral edge at the top side of the longitudinal beam. During stripping of the formwork, i.e. removing the formwork panel, the transverse beam may still be connected to the formwork. In this case, when lowering the middle part of the head member, the shoulder of the transverse beam comes in contact with an impact area of the longitudinal beam extending below the top side of the longitudinal beam to prevent detachment of the transverse beam from the formwork support system. Furthermore, the transverse beam at its upper side may have a wood or plastic strip for nailing a formwork panel on the wood or plastic strip of the transverse beam. In this case, the shoulder is arranged for removing the nails when the middle part of the head member is lowered during stripping of the formwork. The shoulder may be formed continuous with the abutment element explained above.

In an embodiment, at least one of the head members comprises a lowering device for lowering a middle part of the head member, on which at least one longitudinal beam and/or at least one transverse beam may be supported, with respect to the support plate. Such lowering device may comprise a wedge manually moveable to bring the middle part of the head member from an upper casting position to a lower stripping position, whereas the support plate is arranged at the same vertical position in the upper casting position and the lower stripping position of the middle part of the head member. In this way, the support plate is arranged for shoring the formwork panel in order to support the concrete slab formed thereon.

In an embodiment, a formwork support prop comprises:

a leg having a lower end and an upper end, a head member mounted on the upper end of the leg, the head member having a support plate with an upper side for supporting a formwork thereon, wherein the head member has a recess formed in a side edge of the support plate.

In an embodiment, a formwork support system comprises four support props, each having a leg and a head member mounted on an upper end of the leg, each head member having a support plate with an upper side for supporting a formwork thereon, two longitudinal beams with ends attached to the head members of the support props, respectively, a transverse beam extending transversely to the longitudinal beams, wherein the transverse beam has two catch elements at opposite end regions of the transverse beam, the catch elements engaging slots of the longitudinal beams, the catch elements being spaced apart in a horizontal direction perpendicular to a longitudinal direction of the transverse beam.

This embodiment is particularly advantageous in that the transverse beam may be installed from below by a worker standing on a floor on which the formwork support system is supported. For example, a tool, such as a fork instrument with a fork at one end, may be used to connect the transverse beam to the two longitudinal beams.

In this embodiment, the catch elements may be arranged at opposite sides of the transverse beam at the end regions thereof. Thus, the catch elements are arranged laterally at the end regions of the transverse beams. This construction increases stability and facilitates assembly of the formwork support system.

In an embodiment, the transverse beam comprises abutment elements at the opposite end regions of the transverse beam, the abutment elements being supported on top sides of flanges of the longitudinal beams, the abutment elements being spaced apart in a horizontal direction perpendicular to the longitudinal direction of the transverse beam.

A method of installing a formwork support system comprises the steps of:

a. arranging a first and a second pair of support props in an upright position, the support props each carrying a head member preferably with a support plate, b. connecting two opposite ends of a first longitudinal beam to the head members of the first pair of support props and connecting two opposite ends of a second longitudinal beam to the head members of the second pair of support members, c. connecting two opposite end regions of a transverse beam to the first and second longitudinal beam, respectively, by arranging catch elements at the opposite end regions of the transverse beam in slots of the first and second longitudinal beam, respectively, the catch elements being spaced apart in a horizontal direction perpendicular to a longitudinal direction of the transverse beam.

Another method of installing a formwork support system comprises the steps of:

a. arranging a first and a second pair of support props in an upright position, the support props each carrying a head member preferably with a support plate, b. connecting two opposite ends of a first longitudinal beam to the head members of the first pair of support props and connecting two opposite ends of a second longitudinal beam to the head members of the second pair of support members, c. arranging at least one transverse beam in an interim mounting position by connecting a first end region of the transverse beam to the first longitudinal beam, the transverse beam freely projecting downwardly from the first end region towards the second end region, a stopper at the first end region bearing against the first longitudinal beam, d. arranging the at least one transverse beam in a horizontal support position by lifting the second end region of the transverse beam and connecting the second end region of the transverse beam to the second longitudinal beam.

Advantageously, the transverse beam can be suspended (i.e. held without manual support) in the interim mounting position. In the interim mounting position, the stopper transfers the load from the cantilevering transverse beam to the longitudinal beam. A plurality of transverse beams may be arranged in their interim mounting positions before subsequently lifting the transverse beams into their final support positions.

In this embodiment, the lifting of the second end region of the transverse beam into the horizontal support position may be assisted by a tool, such as a fork instrument.

Another method of installing a formwork support system, comprises the steps of:

a. arranging a first pair of support props in an upright position, the support props having head members, b. connecting two opposite ends of a first longitudinal beam to the head members of the first pair of support props, c. arranging a second longitudinal beam in an interim mounting position by releasably connecting a first end of the second longitudinal beam to the first longitudinal beam, the second longitudinal beam, in the interim mounting position, freely projecting downwardly from the first end towards the second end, a stop element at the first end of the second longitudinal beam, in the interim mounting position, bearing against the first longitudinal beam, a hook element of the second longitudinal beam, in the interim mounting position, engaging a slot of the first longitudinal beam, d. arranging the second longitudinal beam in a horizontal support position by lifting the second end of the second longitudinal beam.

Thus, the arrangement of the second longitudinal beam, in the inclined interim mounting position, is self-supporting by means of the stop element and the hook element.

In an embodiment, the hook element extends downwardly at the first end of the second longitudinal beam.

In an embodiment, the hook element of the second longitudinal beam, in the interim mounting position, engages an undercut of a flange delimiting the slot of the first longitudinal beam.

In an embodiment, the second longitudinal beam, at its first end, has a pin, the pin being supported on a top side of the flange of the first longitudinal beam in the horizontal support position of the second longitudinal beam.

In an embodiment, the slot of the first longitudinal beam extends in a longitudinal direction of the first longitudinal beam at a lateral side thereof.

In an embodiment, the slot extends over the entire length of a main section of the first longitudinal beam, the main section extending between the first end and the second end of the first longitudinal beam.

In an embodiment, the second end of the second longitudinal beam may be connected to any other (longitudinal or transverse) beam or support prop.

In an embodiment, the second end of the second longitudinal beam is connected to a third longitudinal beam. For this purpose, the second longitudinal beam, at its second end, may have a hook element and a stop element as described above. Thus, the second longitudinal beam may extend transversely between the first and the third longitudinal beam. Such arrangement may be particularly helpful when the conditions at the construction site, for example due to columns or walls that have to be avoided, impede the installation of a regular array of longitudinal beams all extending in parallel in longitudinal direction and transverse beams all extending transversely thereto.

In an embodiment, the lifting of the second end of the second longitudinal beam into the horizontal support position may be assisted by a tool, such as a fork instrument, or by another support prop releasably connected to the second end of the second longitudinal beam.

In an embodiment, the downwardly extending hook element of the second longitudinal beam is accommodated inside the longitudinally extending slot of the first longitudinal beam in the horizontal support position, the downwardly extending hook element being released from its engagement with the flange of the first longitudinal beam.

Another method of installing a formwork support system at least comprises the steps of:

a. arranging a first and a second pair of support props in an upright position, the support props each carrying a head member with a support plate having an upper side, b. connecting two ends of a first longitudinal beam to the head members of the first pair of support props and connecting two ends of a second longitudinal beam to the head members of the second pair of support members, c. arranging at least one transverse beam to extend transversely to the at least two longitudinal beams, wherein at least one of the head members has at least one recess formed in the support plate for accommodating an edge portion of one of the ends of one of the longitudinal beams and wherein the edge portion snugly fits into the recess of the support plate of the head member.

In the same fashion, an edge portion of a transverse beam may be accommodated in a recess formed in the support plate, the edge portion of the transverse beam snugly fitting into the recess of the support plate of the head member. In this way, (sideward) tilting of the transverse beam in its support position is easily prevented.

In this embodiment, longitudinal beam or transverse beam may be installed in the formwork support system by lowering one end of the transverse beam or longitudinal beam onto the head member of a support prop such that this end of the transverse beam or longitudinal beam passes through the recess of the head member of the support prop from the top of the head member downwards.

Another method of installing a formwork support system at least comprises the steps of:

a. arranging a first support prop in an upright position, the first support prop having a head member, b. arranging a beam in an interim mounting position by connecting a first end of the beam to the head member of the first support prop, the beam, in the interim mounting position, freely projecting downwardly from the first end towards the second end, c. releasably connecting an upwardly projecting holding element of a second support prop to the second end of the beam, the second support prop being arranged in an inclined interim position with a lower end of the second support prop being supported on a floor, d. moving the second support prop into an upright position, thereby lifting the second end of the beam to a horizontal support position.

In an embodiment, the beam is one of a longitudinal beam or a transverse beam as described above.

In an embodiment, a stop member at the first end of the beam bears against the first support prop in the interim mounting position. The stop member may be either of the stop element of the longitudinal beam or the stopper of the transverse beam.

As an advantage of the embodiments described above, a transverse or longitudinal beam may be easily installed from the floor below while supporting the weight of the transverse or longitudinal beam, by means of the second support prop having the upwardly projecting holding element, on the floor. During installation, a support element of the beam, in particular the pin of the longitudinal beam or the bolt of the transverse beam, is placed at the back side of the upwardly projecting holding element which prevents an inadvertent disconnection of the second support prop from the beam during lifting of the beam into the horizontal final position. Preferably, the holding element has an inwardly pointing hook at the free end thereof which helps catching the support element on the respective beam.

In an embodiment, the holding element adjoins a groove for supporting a pin of a longitudinal beam or a channel for supporting a bolt of a transverse beam. In use, the groove or channel accommodates the pin or bolt, respectively. As the groove or channel is open towards its upper end, the longitudinal or transverse beam may be easily removed from the respective formwork support prop.

In an embodiment, the groove or channel is arranged at the lower end of the holding element. Thus, when the second support prop reaches its upright position, the pin or bolt slips into the groove or channel to provide secure support of the longitudinal or transverse beam, respectively.

In an embodiment, the head member has a support plate with an upper side for supporting a formwork thereon as described above.

In an embodiment, the holding element is arranged below the support plate of the head member.

In an embodiment, an array of at least two longitudinal beams and at least one transverse beams is installed before adding a longitudinal or transverse beam with the method described before.

BRIEF DESCRIPTION OF THE DRAWINGS

Other objects and features of the present disclosure will become apparent from the following detailed description considered in connection with the accompanying drawings. It is to be understood, however, that the drawings are designed as an illustration only and not as a definition of the limits of the present disclosure.

In the drawings.

DETAILED DESCRIPTION OF THE DRAWINGS

Figure 1:
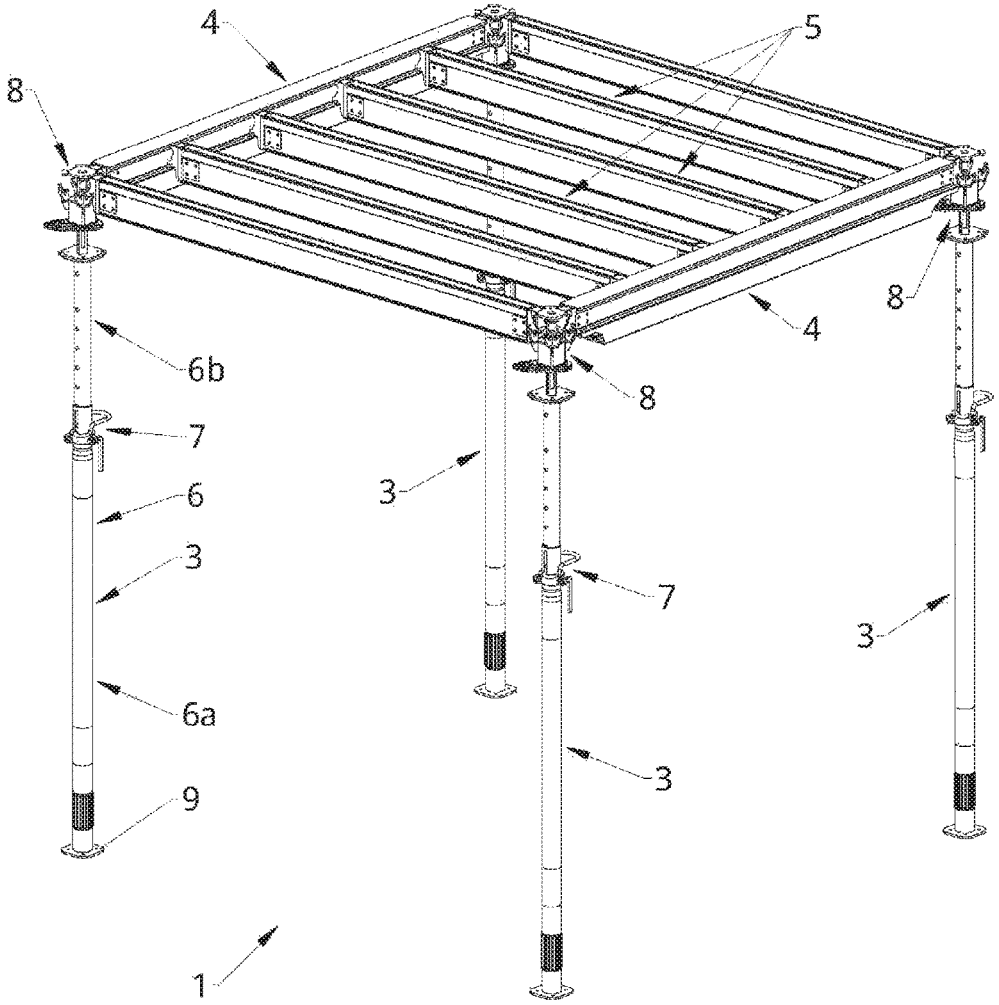
FIGS. 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52 and 53 show various views of a formwork support system and its components in different stages of the assembly of the formwork support system.
Figure 6:
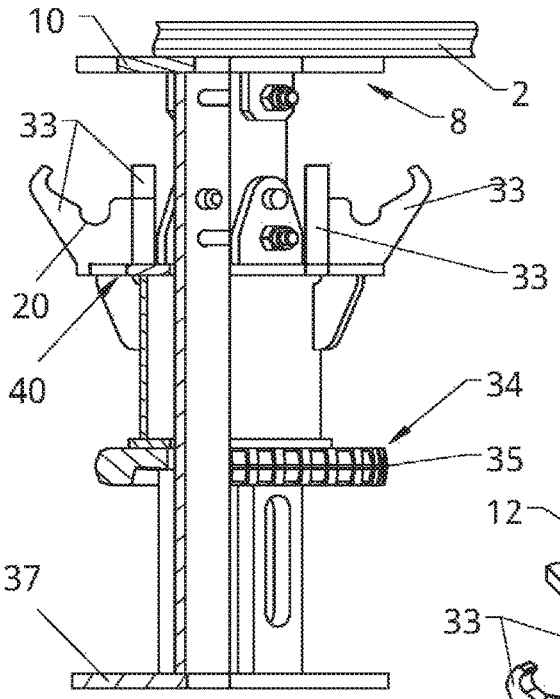

FIG. 1 shows a formwork support system 1 for support of a number of formworks, in particular formwork sheets (panels) of plywood 2 (schematically illustrated in FIG. 6). Such shoring and decking system is used for pouring generally horizontally extending concrete slabs, such as ceilings or floors.

The formwork support system 1 comprises a plurality of support props or support posts 3, a plurality of longitudinal beams, i.e. longitudinal carriers or stringer frames, 4 supported on the support props 3 and a plurality of transverse beams, i.e. crossbars or joist frames, 5 either supported on the support props 3 or on the longitudinal beams 4. The transverse beams 5 extend transversely, optionally perpendicularly, to the longitudinal beams 4. As can be seen from the drawings, the longitudinal beams 4 and the transverse beams 5 are arranged and connected to each other on the same vertical level thereby forming one single horizontal support area for the formworks.

Each support prop 3 has a leg 6 with a lower leg part 6*a*, an upper leg part 6*b* and a connecting device 7 for securing the upper leg part 6*b* in a plurality of vertical positions with respect to the lower leg part 6*a*. In the shown example, the connecting device 7 has a bracket which may be inserted into one of a plurality of vertically spaced attachment openings of the support prop 3. Furthermore, each support prop 3 comprises a head member 8 mounted on an upper end of the upper leg part 6*b* of the leg 6. The leg 6 of the support prop 3 further has a floor support plate 9 at a lower end of the lower leg part 6*a*.

Figure 2:
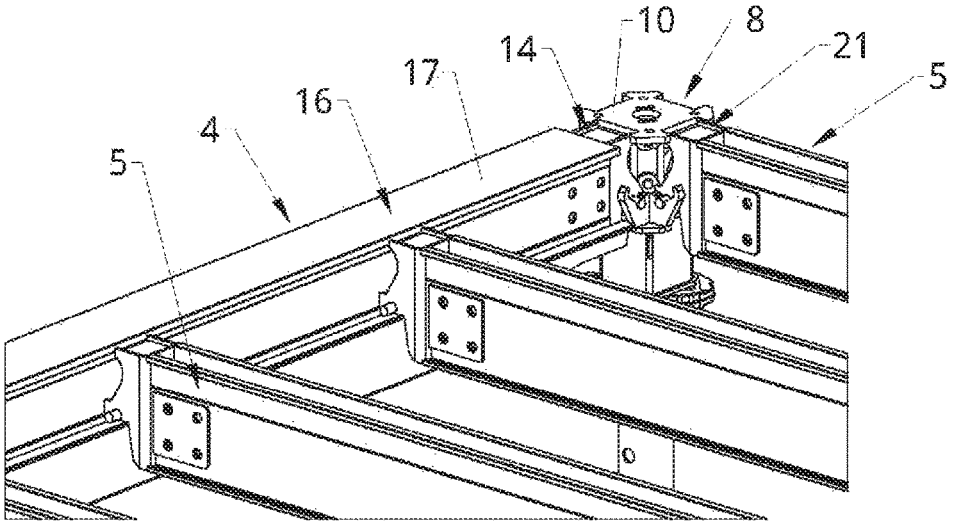
Figure 3:
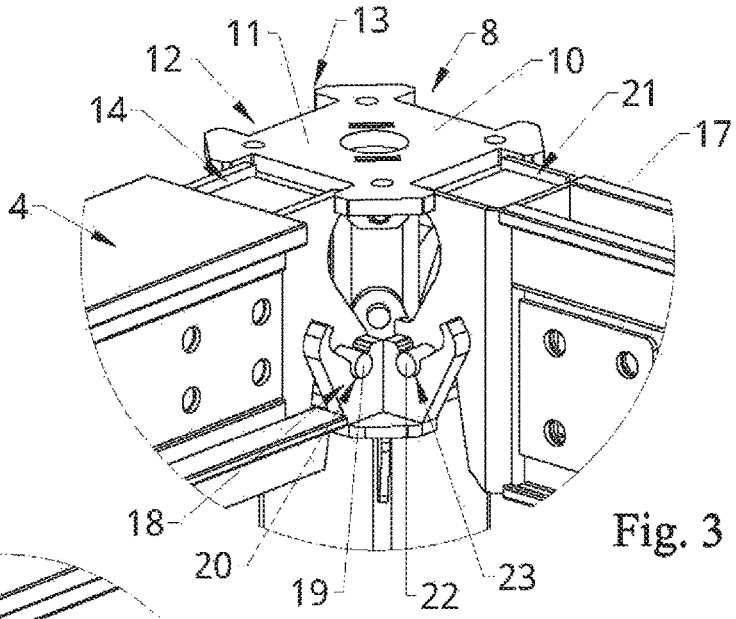
Figure 4:
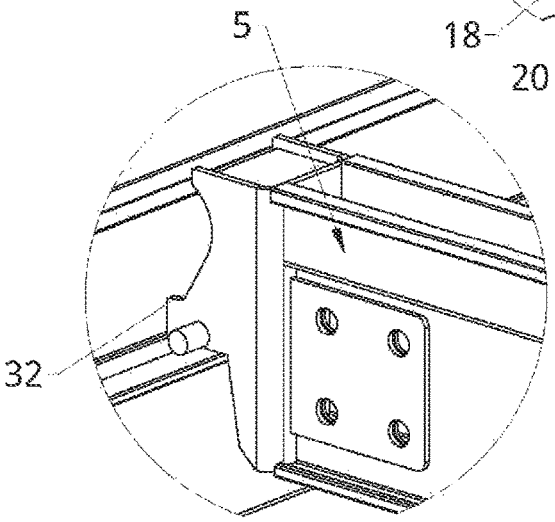

As can be best seen in FIGS. 2 to 4, each head member 8 at its upper end has a support plate 10 with an upper side 11 for supporting the formwork 2 thereon. In the shown embodiment, the support plate 10 has a constant wall thickness (i.e. extension in vertical direction). More generally speaking, the support plate 10 has a plane, horizontally extending upper side 11, whereas the shape of the support plate 10 below the upper side 11 may vary. The support plate 10 has at least one recess 12 formed in a side edge 13 thereof. This recess 12 accommodates an edge portion 14 of the respective end of the longitudinal beam 4. The edge portion 14 of the longitudinal beam 4 and the recess 12 have corresponding extensions in direction perpendicular to the longitudinal axis 15 of the longitudinal beam 4 (illustrated in FIG. 7) such that the edge portion 14 snugly fits into the recess 12 of the support plate 10 of the head member 8. In the assembled state, the snug fit between the edge portion 14 of the longitudinal beam 4 and the recess 12 of the head member 8 prevents tilting of the longitudinal beam 4 with respect to its longitudinal axis 15. Each longitudinal beam 4 comprises a main longitudinal section 16 extending between the opposite ends of the longitudinal beam 4. In the assembled state, the connection of the longitudinal beam 4 with the head member 8 results in a top side 17 of the main longitudinal section 16 of the longitudinal beam 4 being arranged flush with the upper side 11 of the support plate 10 of the head member 8.

In the shown embodiment, the support plate 10 comprises one recess 12 in each one of the four sides of the support plate 10 which has a square ground shape in top view. In this embodiment, neighboring recesses 12 are arranged perpendicular to one another. In this way, the head member 8 forms a crosshead for connection with four longitudinal beams 4 and/or transverse beams 5.

In the assembled state, the end of the longitudinal beam 4 extends downwards from the recess 12 in the support plate 10 of the head member. Furthermore, the head member 8 comprises an intermediary plate 40 arranged between the upper end of the head member 8 and the lower end thereof. The intermediary plate 40 comprises clearances 41 corresponding to the recesses 12 in the support plate 10 (see FIG. 5, 6).

The releasable connection between the longitudinal beam 4 and the head member 8 further comprises a support device 18 (see FIG. 3) for supporting the respective end of the longitudinal beam 4 on the head member 8 in a vertical direction. In the shown embodiment, the support device 18 comprises a pin 19 and a groove 20. The pin 19 is arranged on the longitudinal beam 4 below the edge portion 14 of the head member 8. The groove 20 is arranged on the head member 8 below its support plate 10.

The support device 18 serves for vertically supporting the longitudinal beam 4 on the head member 8, while the form-fit between the edge portion 14 of the longitudinal beam 4 and the recess 12 of the support plate 10 of the head member 8 prevents tilting of the longitudinal beam 4 with respect to its longitudinal axis.

As can be seen from FIGS. 1 to 3, each transverse beam 5 has opposite end regions 21 that snugly fit into the recesses 12 of the head member 8. Furthermore, each transverse beam 5 comprises a bolt 22 that connects to channels 23 of the head members 8. Bolt 22 and channel 23 for attaching the transverse beam 5 to the head member 8 may be identical to pin 19 and groove 20 for attaching the longitudinal beam 4 to the head member 8. For example, two longitudinal beams 4 and two transverse beams 5 may be connected to the same head member 8. As can be seen in FIG. 45 to FIG. 50, transverse beam 5 and longitudinal beam 4 may be lowered on the head members 8 of the respective support props 3 from a position above head member 8.

Figure 7:
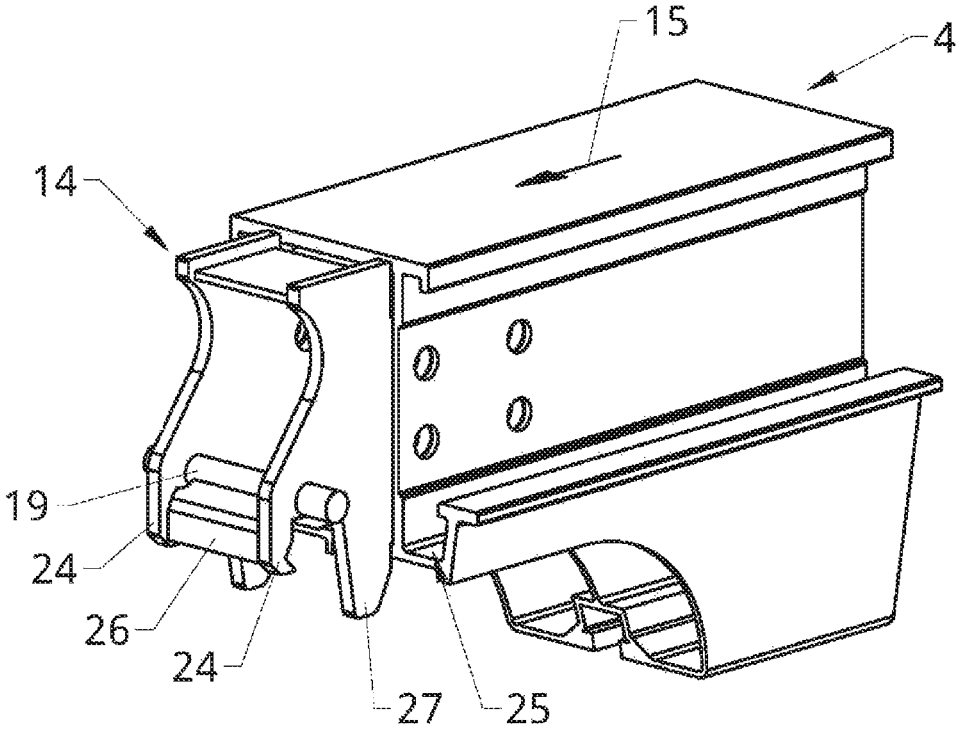
Figure 14:
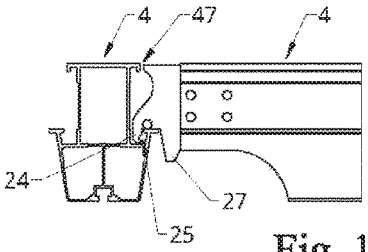
Figure 16:
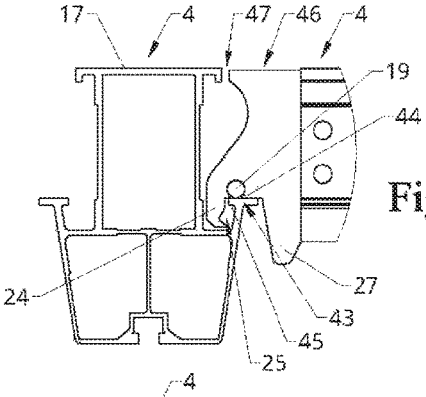

As can best be seen from FIGS. 7, 14 and 16, the longitudinal beams 4 each comprise at least one downwardly projecting hook element 24 and a slot 25 extending in longitudinal direction 15 of the longitudinal beam 4. In this way, the hook element 24 of one longitudinal beam 4 can be connected to the slot 25 of another longitudinal beam 4. In the shown example, the longitudinal beam 4 comprises two hook elements 24 spaced in direction perpendicular to the longitudinal axis 15 and a bracing 26 connecting the two hook elements 24.

Figure 11:
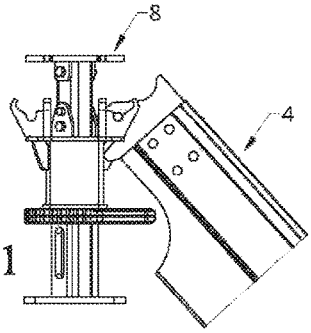
Figure 15:
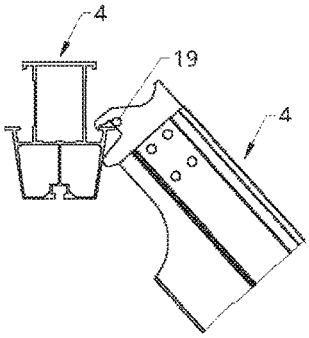
Figure 12:
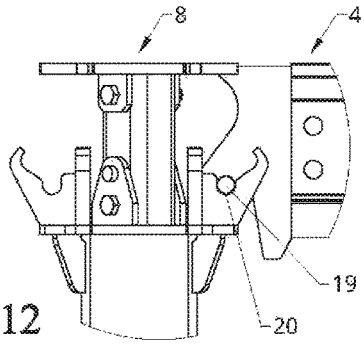
Figure 13:
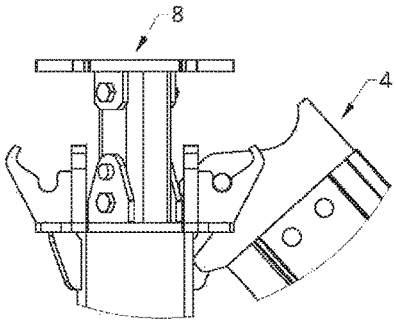
Figure 17:
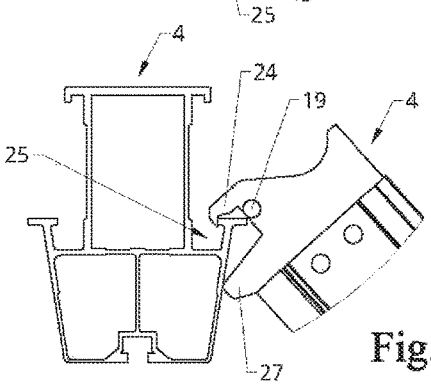
Figure 18:
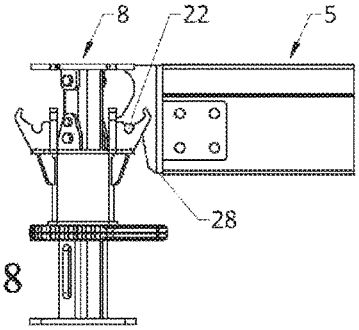

Furthermore, the longitudinal beam 4 comprises a downwardly projecting stop element 27. As can best be seen from FIGS. 11, 13 and FIGS. 15, 17, respectively, the stop element 27 facilitates assembly of the formwork support system 1. First, when connecting a longitudinal beam 4 arranged in an inclined interim mounting position (FIG. 11, FIG. 13) to one of the head members 8, the stop element 27 of the longitudinal beam 4 abuts on the head member 8 of prop 3 to facilitate assembly and improve safety. Second, when connecting a first longitudinal beam 4 arranged in an inclined interim mounting position to a second longitudinal beam 4 arranged in a horizontal final position by means of the hook element 24 of the first longitudinal beam 4 and the slot 25 of the second longitudinal beam 4, the stop element 27 of the first longitudinal beam 4 abuts on a lateral face of the second longitudinal beam 4 (FIG. 15, FIG. 17). In the final position, the stop element 27 of the longitudinal beam 4 is spaced apart from the head member 8 or the other longitudinal beam 4, respectively.

As can be seen from FIGS. 18 to 25, the transverse beam 5 at its end regions comprises stoppers 28, which may be identical to the stop elements 27 of the longitudinal beams 4. When attaching the transverse beam 5 to the head member 8, the transverse beam 5 is first arranged in an interim mounting position extending downwardly towards its free end (see FIG. 19 and FIG. 21) by connecting the bolt 22 of the transverse beam 5 to the channel 23 of the head member 8. In this inclined interim mounting position, the stopper 28 of the transverse beam 5 bears against the head member 8. By lifting the transverse beam 5 from the interim mounting position into its horizontally extending final position, the stopper 28 is placed at a distance from the head member 8.

Furthermore, the transverse beam 5 comprises a downwardly projecting catch element 29 for connection with the slot 25 of the longitudinal beam 4 (see FIGS. 22 to 25). The stopper 28 of the transverse beam 5 bears against a lateral side of the longitudinal beam 4 when the transverse beam 5 is arranged in an inclined interim mounting position (see FIGS. 23 and 25).

The catch element 29 of the transverse beam 5, the hook element 24 of the longitudinal beam 4 and the slot 25 of the longitudinal beam 4 have a shape which provides for an adequate pivoting range in the slot 25.

Figure 8:
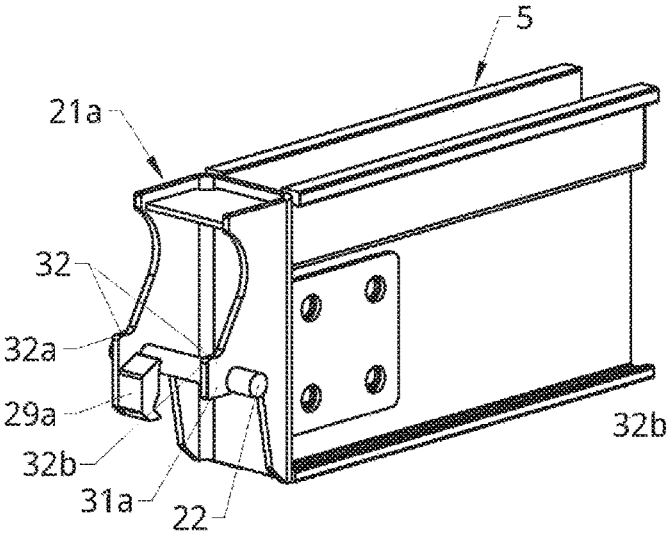
Figure 9:
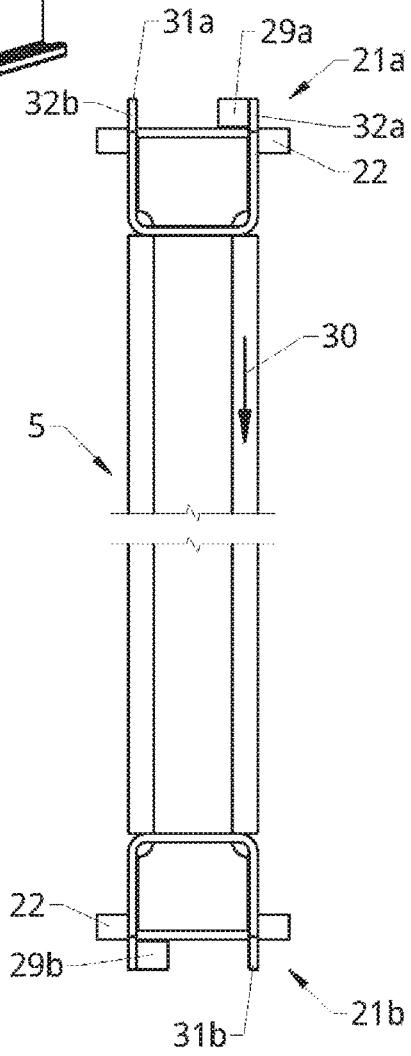
Figure 10:
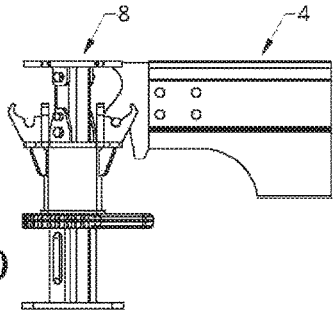

As can best be seen from FIGS. 8, 9, the transverse beam 5 comprises a first catch element 29*a* at a first end region 21*a* of the transverse beam 5 and a second catch element 29*b* at a second end region 21*b* of the transverse beam 5. In the assembled state, each of the first catch element 29*a* and the second catch element 29*b* is connected to the slots 25 of the longitudinal beams 4. For facilitating assembly of the formwork support system 1, the first catch element 29*a* and the second catch element 29*b* are spaced apart in direction perpendicular to a longitudinal direction 30 (see FIG. 9) of the transverse beam 5. In view of increasing stability of the arrangement, the transverse beam 5 further comprises a first abutment element 31*a* at the first end region 21*a* of the transverse beam 5 and a second abutment element 31*b* at the second end region 21*b* of the transverse beam 5. The first catch element 29*a* and the second catch element 29*b* extend below the first abutment element 31*a* and the second abutment element 31*b*. The first catch element 29*a* at the first end region 21*a* and the second abutment element 31*b* at the second end region 21*b* are arranged at the same horizontal position in direction perpendicular to the longitudinal direction 30 of the transverse beam 5. Likewise, the first abutment element 31*a* at the first end region 21*a* and the second catch element 29*b* at the second end region 21*b* are arranged at the same horizontal position in direction perpendicular to the longitudinal direction 30 of the transverse beam 5. In other words, the horizontal position of the catch elements and the abutment elements on the opposite end regions of the transverse beam is interchanged. This arrangement facilitates mounting of the transverse beams 5 to the longitudinal beams 4 when erecting and stripping the formwork support system, which will be described below.

As can be seen from FIGS. 14 to 17 and FIGS. 22 to 25, the slot 25 of the longitudinal beam 4 is delimited by a flange 43 with a top side 44 and an undercut (back taper) 45.

The top side 44 of the flange 43 is arranged for supporting the pin 19 of the longitudinal beam 4 in its final (support) position (see FIG. 16). Furthermore, the top side 44 of the flange 43 is arranged for supporting the bolt 22 or the first abutment element 31*a* or second abutment element 31*b* of the transverse beam 5.

Figure 23:
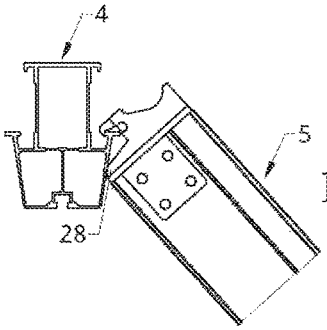

On the other hand, the undercut 45 of the flange 43 is arranged for holding the hook element 24 of the longitudinal beam 4 in its inclined interim mounting position (see FIG. 15, 17) and for holding the catch element 29 of the transverse beam 5 in its inclined interim mounting position (see FIG. 23, 25)

Furthermore, the transverse beam 5 at each end region 21 comprises at least one shoulder 32. In the shown example, two shoulders 32 are provided on either end region 21. A first shoulder 32*a* is formed by a projection of the first catch element 29*a*, a second shoulder 32*b* is formed by a projection of the first abutment element 31*a*.

Figure 5:
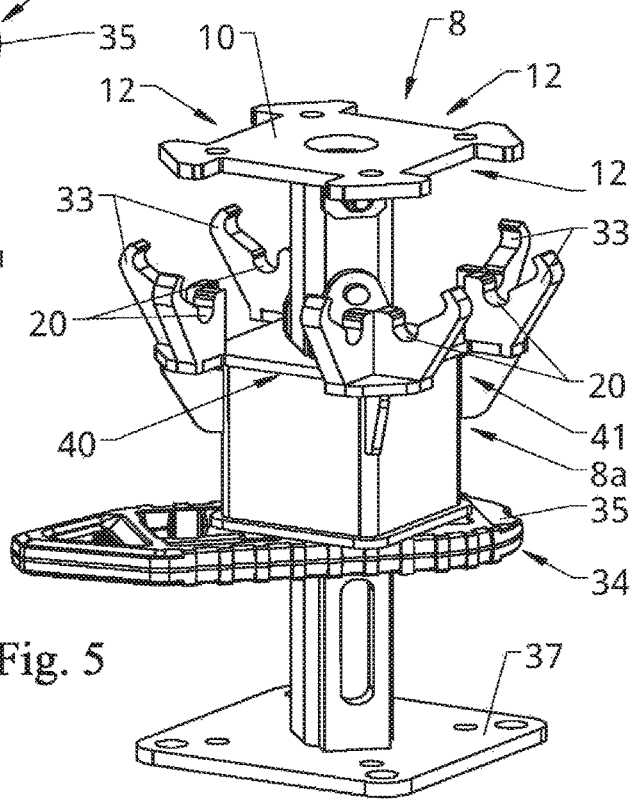
Figure 27:
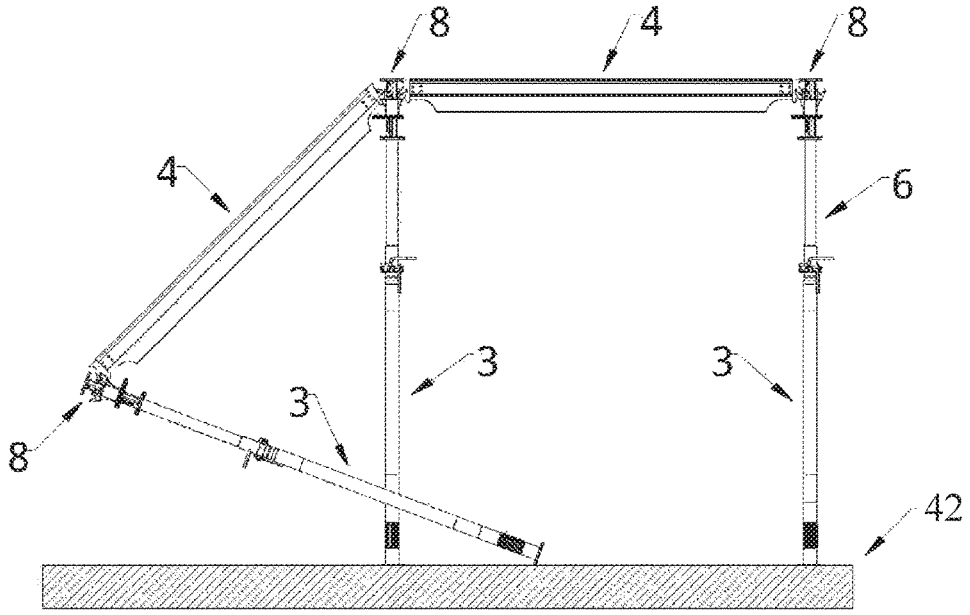
Figure 28:
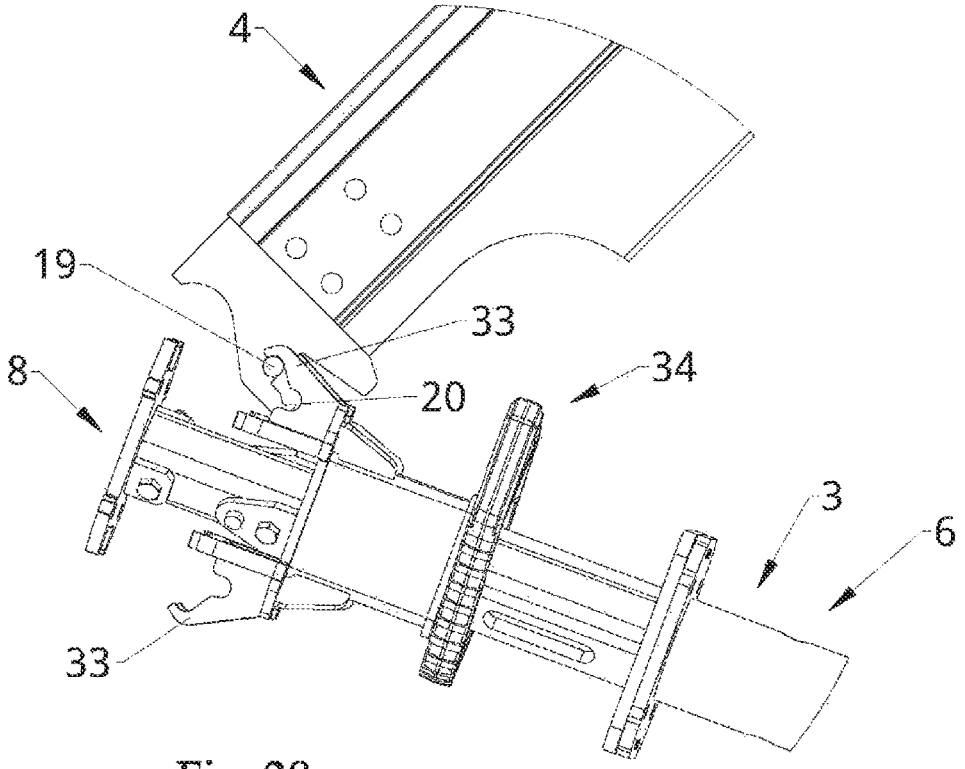
Figure 29:
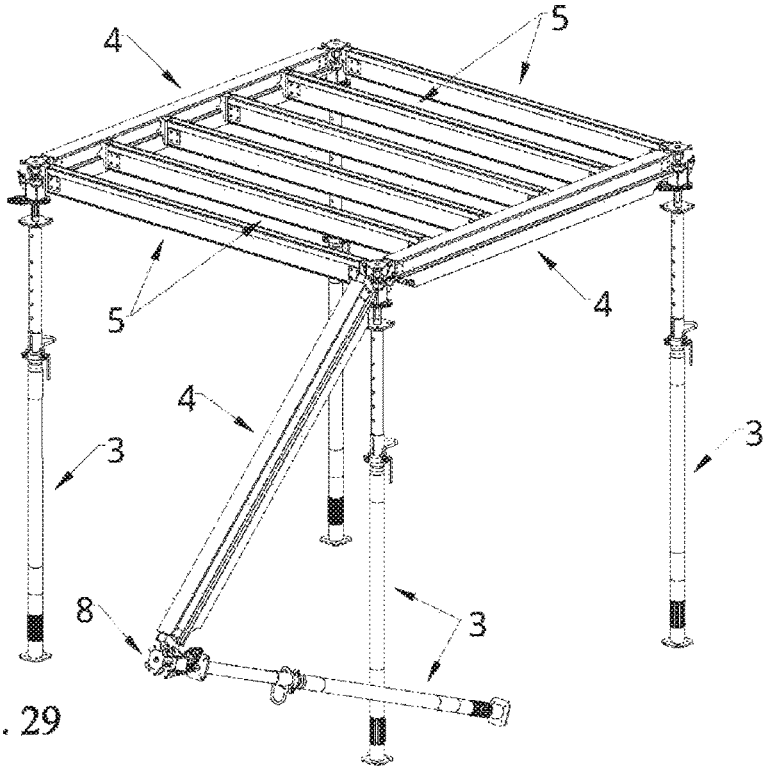

As can best be seen from FIG. 5, FIG. 6 in conjunction with FIG. 27 and FIG. 28, the head members 8 each comprise at least one upwardly projecting holding element 33 with a hook formed at its upper (free) end. In the shown example, two holding elements 33 are provided on either side of the head member 8. Thus, each head member 8 has a total of eight holding elements 33. As can be seen from FIG. 27 and FIG. 28, the holding elements 33 are used for holding the pin 19 of the longitudinal beam 4 when the support prop 3 is brought from an inclined interim position with the lower end of the leg 6 supported on a floor 42 of a building under construction (see FIG. 27, left support prop 3) to an upright support position (see FIG. 27, middle and right support prop 3). Lifting the beams into their horizontal support position for connecting with the head member 8 can, hence, be done without the need to lift up the heavy weight of the beam and the prop 3.

As can best be seen from FIG. 5, 6, the head member 8 comprises a lowering device 34 for lowering a middle part 8*a* of the head member 8 with respect to the support plate 10. Thus, the middle part 8*a* may be lowered from the shown upper casting position towards the upper end of the leg 6 to a lower stripping position (not shown). The middle part 8*a* is arranged for supporting at least one of the longitudinal beam 4 and/or the transverse beam 5. For this purpose, the middle part 8*a*, in the shown example, has the grooves 20 for accommodating the pin 19 of the longitudinal beam 4 or the bolt 22 of the transverse beam 5. The lowering device 34 enables a drop head function, which is known in the prior art. In the shown example, the lowering device 34 comprises a wedge 35 which may be moved from a locking position (shown in FIG. 5, 6) to a release position (not shown) for lowering the middle part 8*a* of the head member 8. In the lower stripping position, the middle part 8*a* of the head member 8 is supported by an attachment plate 37 at a lower end of the head member 8 which is mounted on the upper end of the leg 6. The support plate 10 rests in place for supporting the formwork panel and the concrete slab positioned thereon.

Figure 26:
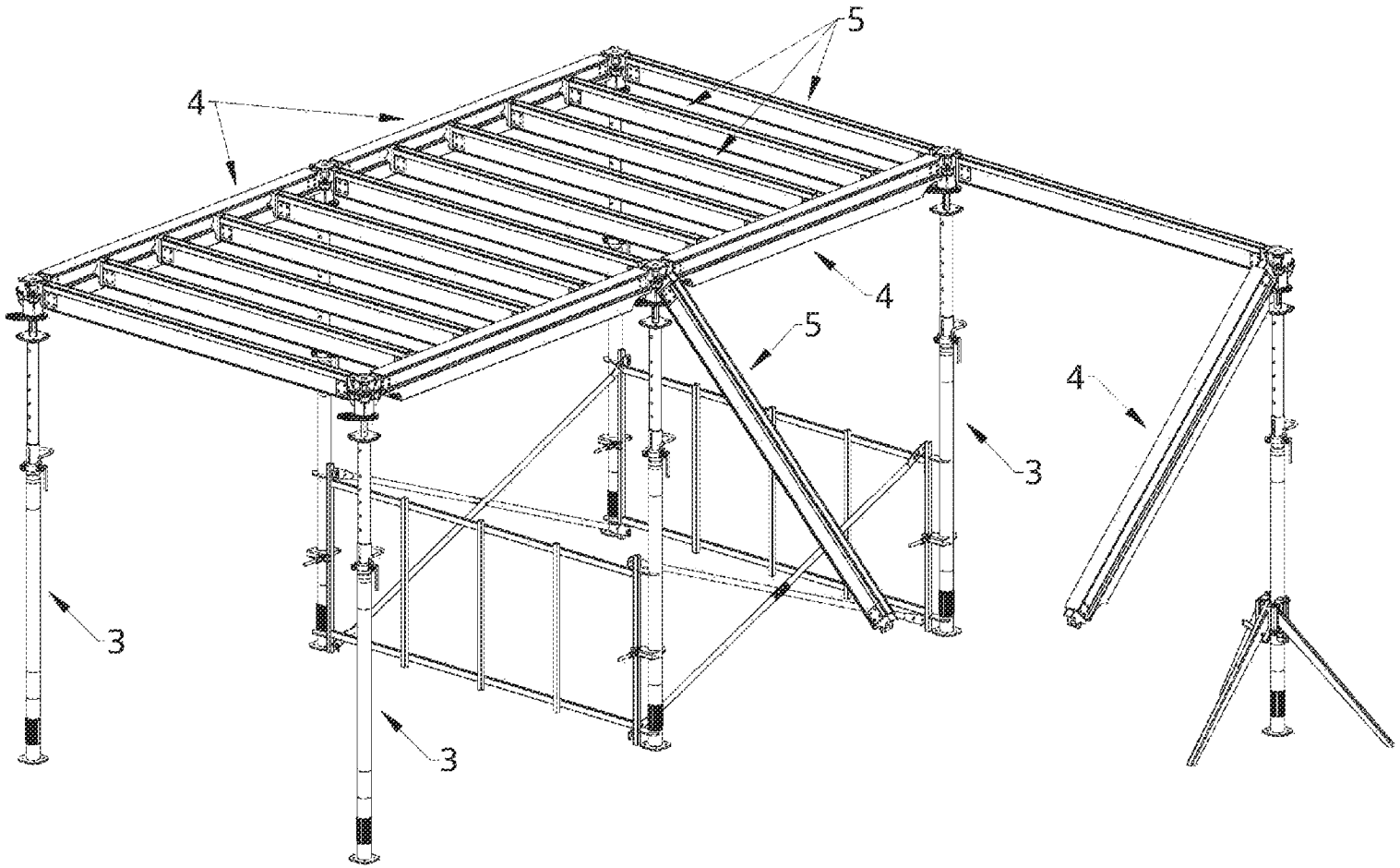

FIG. 26 shows the formwork support system 1 during assembly. In this example, one longitudinal beam 4 and one transverse beam 5 are connected to the existing arrangement.

Figure 30:
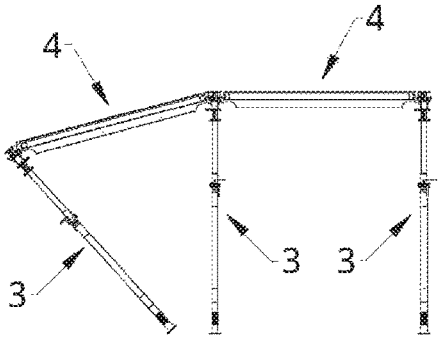
Figure 31:
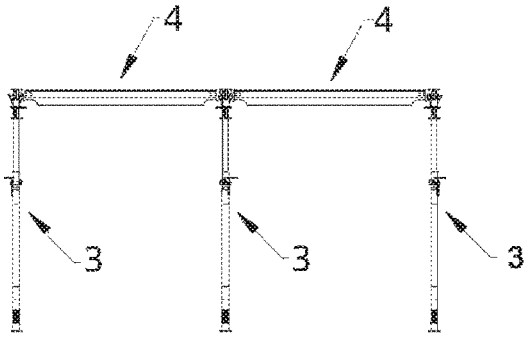

FIGS. 27 to 31 illustrate further mounting of a longitudinal beam 4 by means of one of the support props 3. First, one end of the longitudinal beam 4 is connected to the head member 8 of a support prop 3 installed before. Then, the other end of the longitudinal beam 4 is connected to the support prop 3 by placing the pin 19 in the holding element 33 which adjoins the groove 20. The support prop 3 may then gradually be lifted to its upright final position (see. FIGS. 30, 31).

Figure 32:
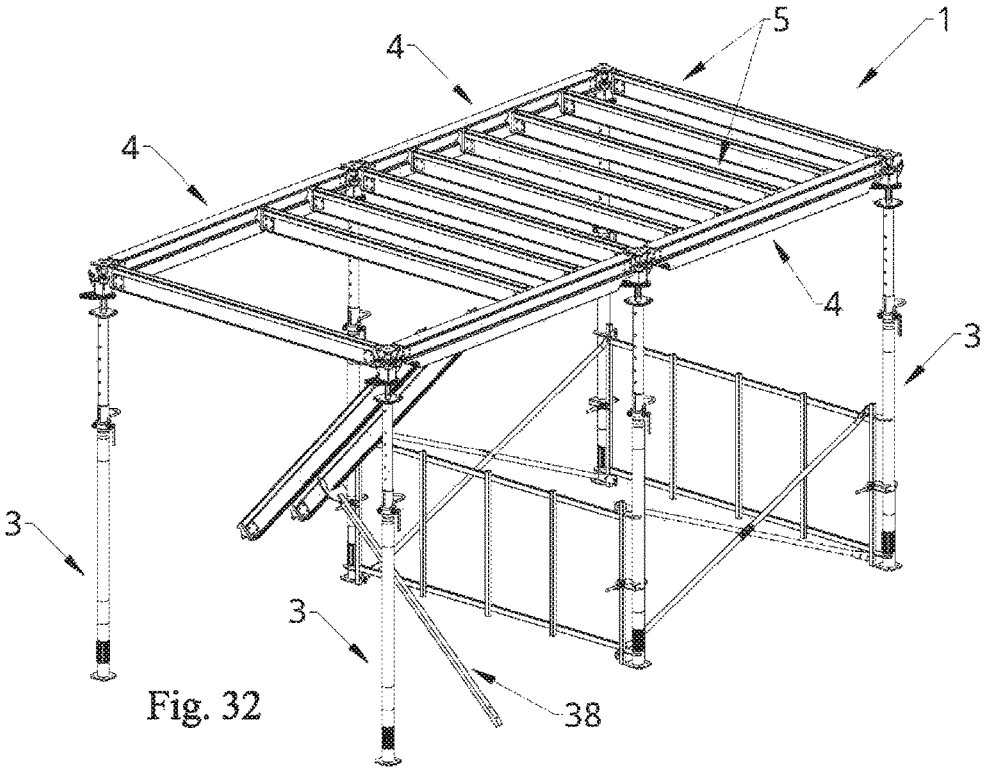
Figure 33:
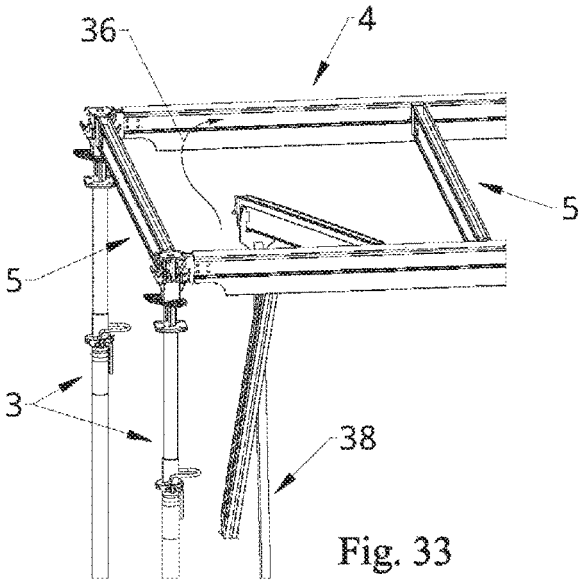
Figure 34:
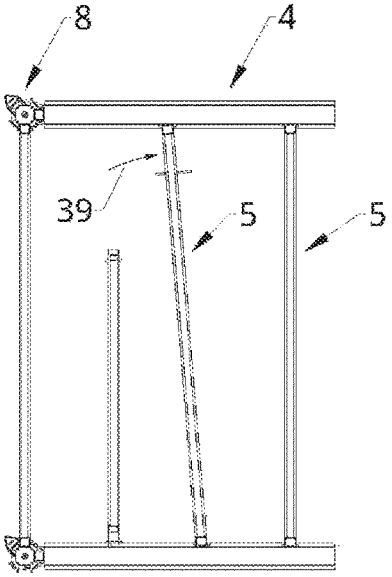

FIGS. 32 to 34 illustrate further the mounting of a transverse beam 5 to the formwork support system 1. For this purpose, one end region of the transverse beam 5 is connected to one of the longitudinal beams 4. Then, a tool, such as a fork instrument 38, is used to lift the transverse beam 5. Due to the interchanged position of the catch elements and abutment elements at the opposite end regions of the transverse beam 5, the end region of the transverse beam 5 supported with the fork 38 may be pivoted sideward to connect to the other longitudinal beam 4, see arrow 36 in FIG. 33 and arrow 39 in FIG. 34. Consequently, the beams 5 can be put into place without the need of lifting them up beyond the top side of the formwork support system 1, i.e. the horizontal plane defined by the top side 17 of the transverse beam 5 and upper side 11 of the head member 8 of the prop 3. This is particularly advantageous when it comes to the stripping of the longitudinal beams 4 and transverse beams 5 since the completed concrete slab may not provide for sufficient room beyond the top side of the longitudinal beams 4 and transverse beams 5, despite the lowering of the beam arrangement by means of the lowering devices 34.

Figure 25:
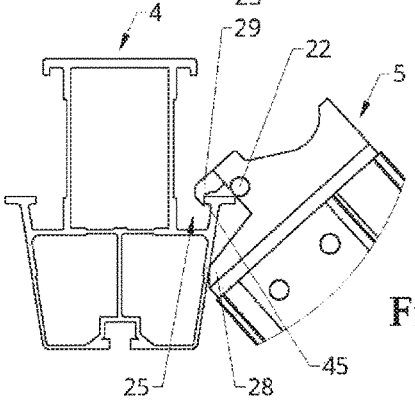

As can additionally be seen from FIGS. 32 to 34 the transverse beams 5 can be held in an interim (intermediary) mounting position in one of the slots 25 of the longitudinal beams 4 by means of the catch elements 29, the abutment elements 31 and the stoppers 28 of the transverse beam 5 and the flange 43 having the undercut 45 of the longitudinal beam 4, into which one of the catch elements 29 can be hooked (as can also be seen in FIG. 25). Two or more transverse beams 5 can be connected to and suspended—by their end regions—from one of the longitudinal beams 4. Their interim free end regions can, then, be lifted up one after the other until all transverse beam 5 are arranged in their horizontal, final support positions. Thus, the formwork support system 1 may be installed by one worker in a fast manner. Depending on its height the formwork support system 1 may even be installed without the tool shown in the drawing.

Figure 20:
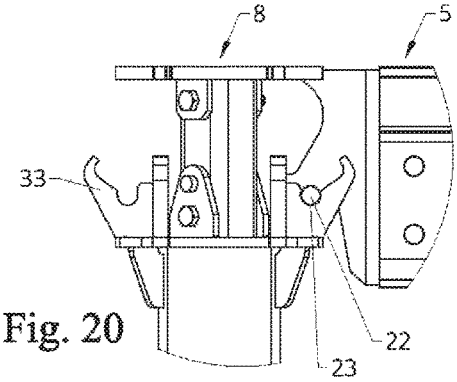
Figure 24:
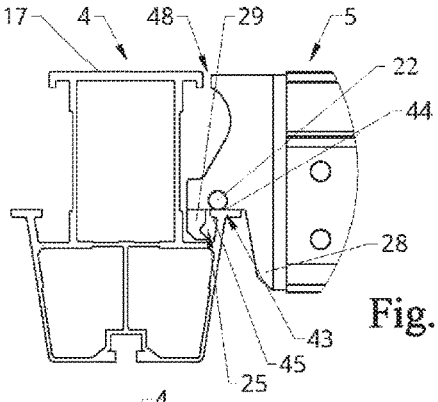
Figure 21:
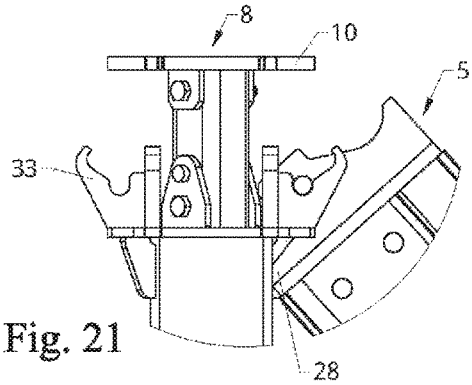
Figure 35:
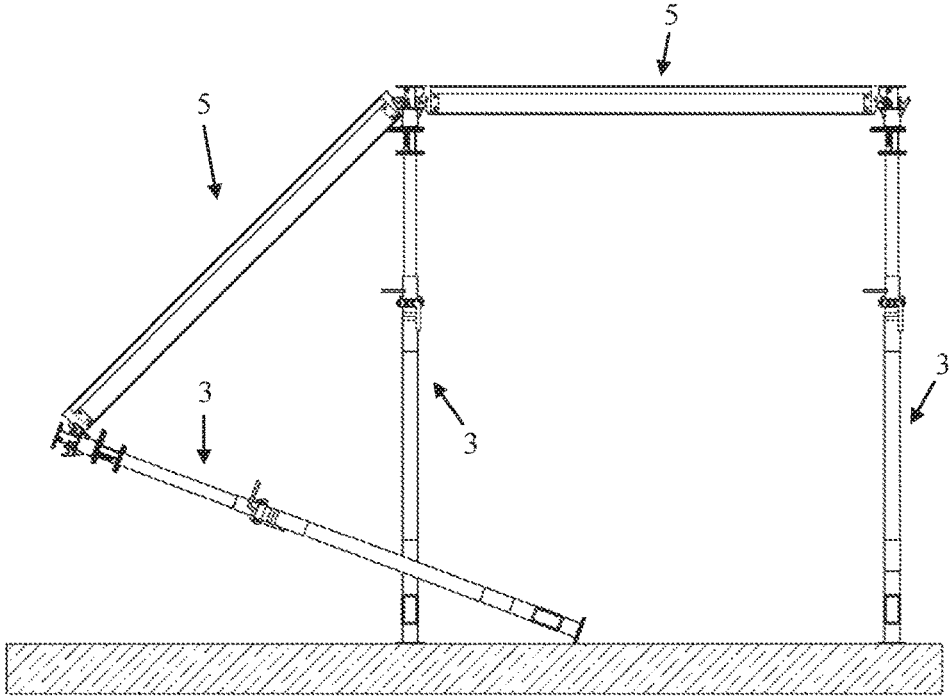
Figure 36:
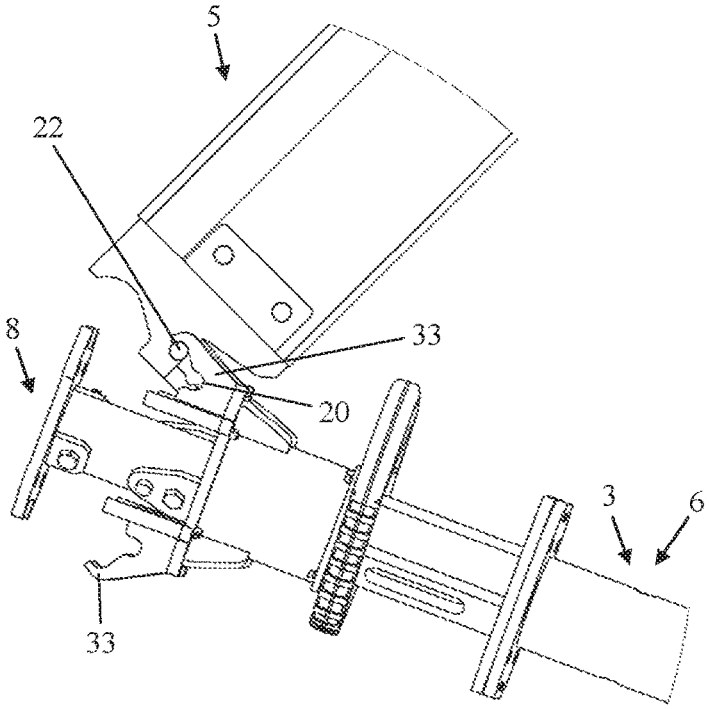
Figure 37:
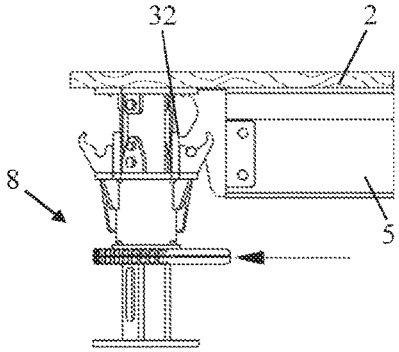
Figure 38:
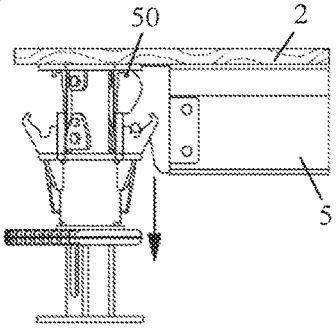
Figure 39:
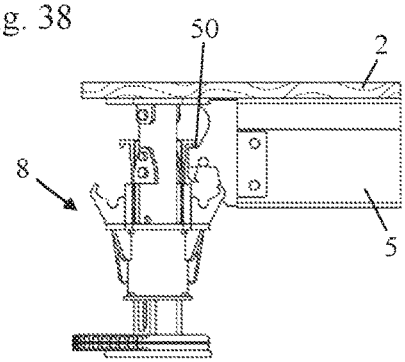
Figure 40:
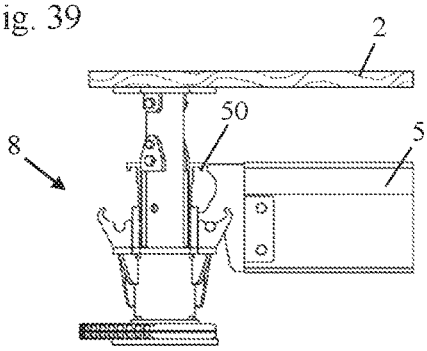
Figure 41:
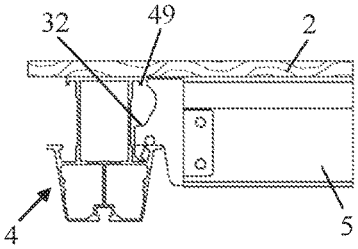
Figure 42:
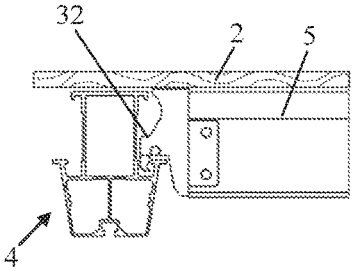
Figure 43:
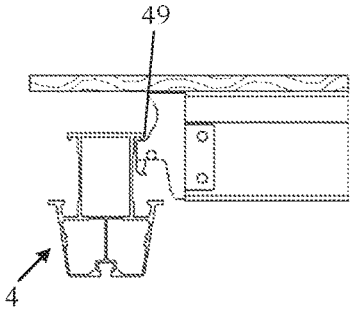
Figure 44:
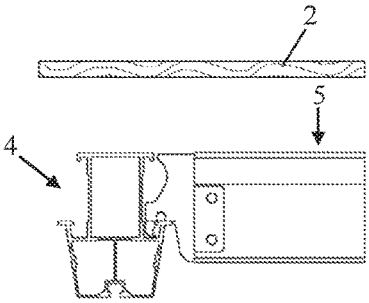
Figure 45:
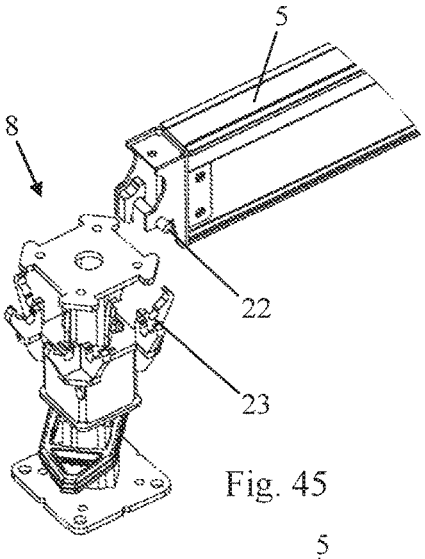

As shown in FIG. 35, 36, any transverse beam 5 that is connected to two support props 3 may be lifted from a self-supporting interim mounting position (as shown in FIG. 21) to a horizontal support position (as shown in FIG. 20) in the same way as longitudinal beam 4 (see FIGS. 28 to 31). Thus, holding element 33 of another support prop 3 is used to catch the bolt 22 on the second end region of transverse beam 5. The lower end of support prop 3 is supported on the floor while support prop 3 is moved from an inclined position to an upright (vertical) position thereby lifting transverse beam 5 into the horizontal support position.

As indicated in FIG. 14, 16, an upper section 46 of the edge portion 14 of the second longitudinal beam 4 in its horizontal position is spaced by a first gap 47 from an outer edge 48 of the top side 17 of the first longitudinal beam 4 to which the second longitudinal beam 4 is connected. The first gap 47 ensures that the longitudinal beams 4 may not only be arranged in the shown horizontal support positions, but also without blocking in inclined support positions (not shown) when the support props 3 are adjusted to different lengths for pouring inclined concrete slabs.

Figure 22:
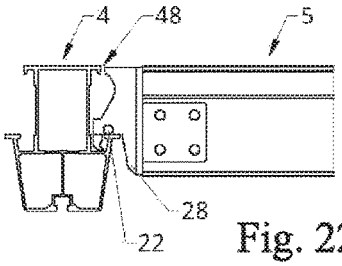
Figure 19:
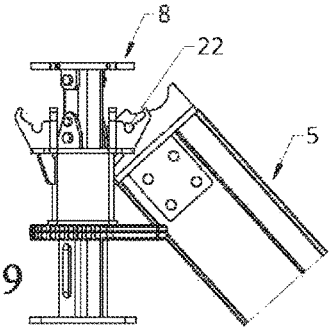

In the same fashion, a second gap 48 is formed at the end regions 21*a*, 21*b* of the transverse beams 5 being connected in a horizontal position to the longitudinal side of the longitudinal beam 4 (see FIG. 22, 24). Such gaps may also be provided for the connection of the longitudinal beam 4 and/or the transverse beam 5 to the head member 8 in a horizontal position, respectively (FIG. 2, 3).

As mentioned before, transverse beam 5 comprises shoulder 32 which ensures the disconnection of the transverse beam 5 from the formwork panel 2 during stripping of the formwork by actuation of head member 8 of support prop 3 (see FIG. 5, 6). FIGS. 37 to 40 show one of the transverse beams 5 arranged between two support props 3. FIGS. 41 to 44 show one of the transverse beams 5 connected between two longitudinal beams 4. In the latter example, shoulder 32 extends horizontally below a lateral edge at the top side 17 of longitudinal beam 4. During stripping of the formwork, i.e. removal of formwork panel 2 through actuation of the head members 8 of the corresponding support props 3 (see horizontal arrow in FIG. 37), transverse beam 5 may still be connected to the formwork, for example by means of nails projecting through the formwork panel 2 into a wooden strip on top of transverse beam 5. When lowering the middle part of head member 8 (see vertical arrow in FIG. 38), shoulder 32 of transverse beam 5 comes into contact with an impact area 49 of longitudinal beam 4 extending below the top side of the longitudinal beam 4 to ensure lowering or movement of the transverse beam 5 together with the longitudinal beam 4 and to prevent deficient stripping of the formwork system. In the former example, shoulder 32 extends horizontally below a flange portion 50 of head member 8 which serves as an impact region for shoulder 32 during stripping of the formwork.

Figure 48:
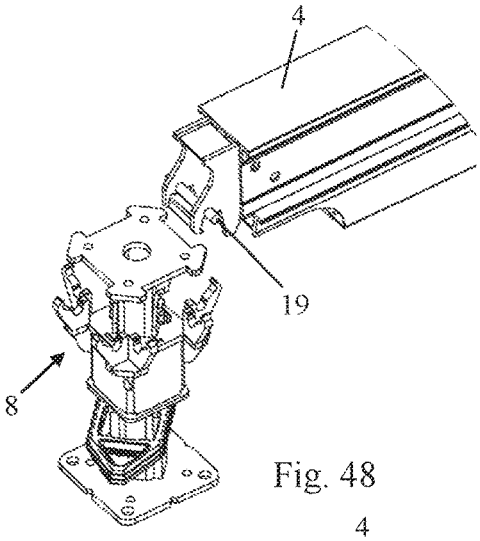
Figure 46:
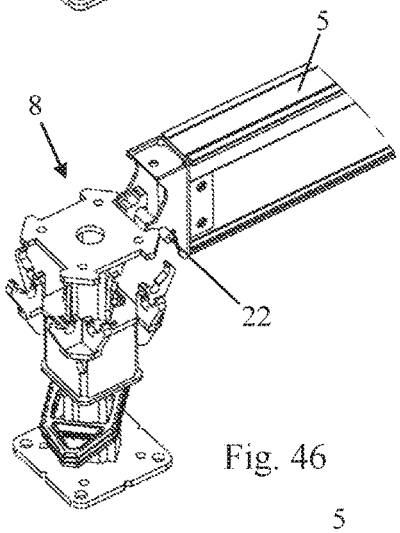
Figure 49:
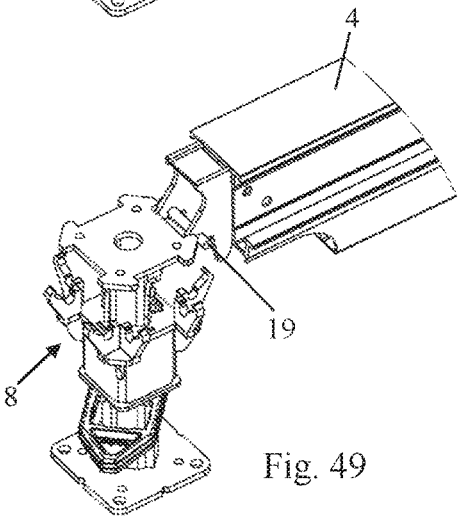
Figure 47:
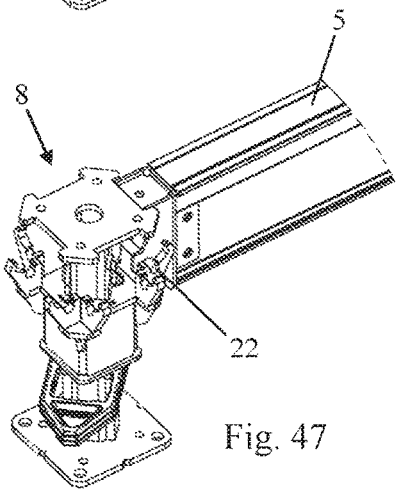
Figure 50:
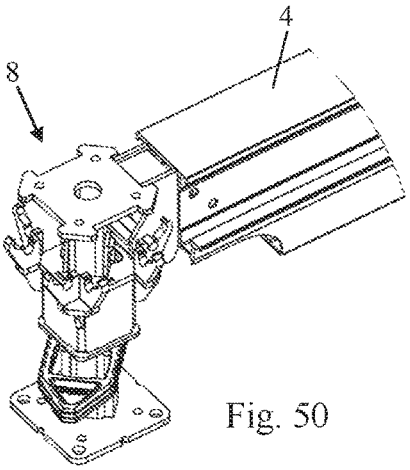

As can be seen from FIGS. 48 to 50, longitudinal beam 4 may be mounted to a head member 8 of a support prop 3 by lowering longitudinal beam 4 from above the head member 8 vertically downwards, thereby passing hook element 24 and bracing 26 of the edge portion 14 of the longitudinal beam 4 through the recesses 12 of the head member 8. The lower section of the edge portion 14 having the hook element 24 and the bracing 26 is extending beyond the upper section of edge portion 14. Thus, the beam 4 is then moved slightly towards the (middle part of the) head member 8 into the space provided (and confined) by the support plate 10 of the head member 8 until pins 19 on opposite ends of longitudinal beam 4 are accommodated by correspondingly shaped grooves 20 provided in the head members 8. The edge portions 14 of longitudinal beam 4 at its opposite ends are connected to recesses 12 of head members 8 of the other (neighboring) support prop 3, which may laterally be tilted so that the edge portions 14 of the opposite ends of the longitudinal beam 4 can pass through the recesses 12 of the head members 8 of the other neighboring support prop 3. Likewise, transverse beam 5 may also be connected to head members 8 by lowering transverse beam 5 onto head members 8 of support props 3 until bolts 22 of transverse beam 5 are inserted into channels 23 of head members 8.

Figure 51:
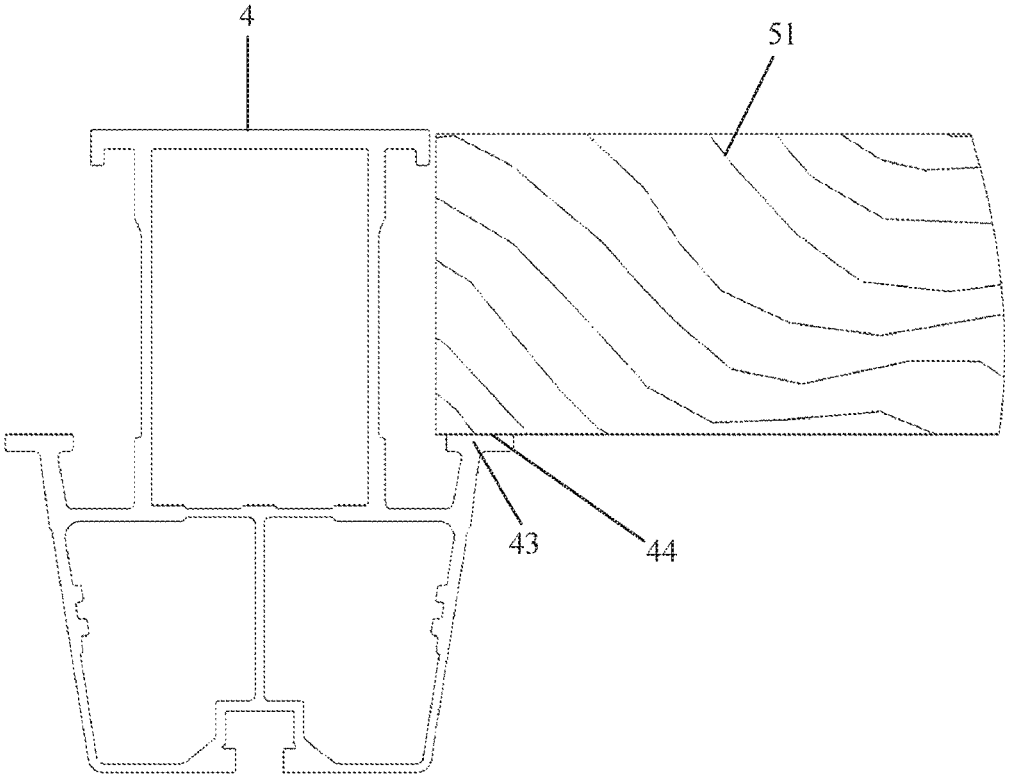

As can be seen from FIG. 51, formwork support system 1 may further comprise a wooden transverse beam 51 that may be supported on top side 44 of flange 43 of longitudinal beam 4.

Figure 52:
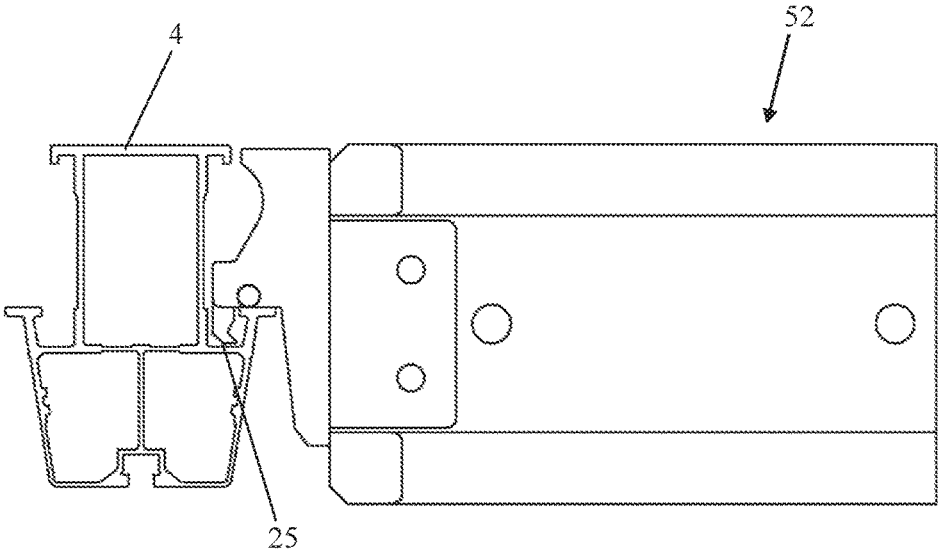
Figure 53:
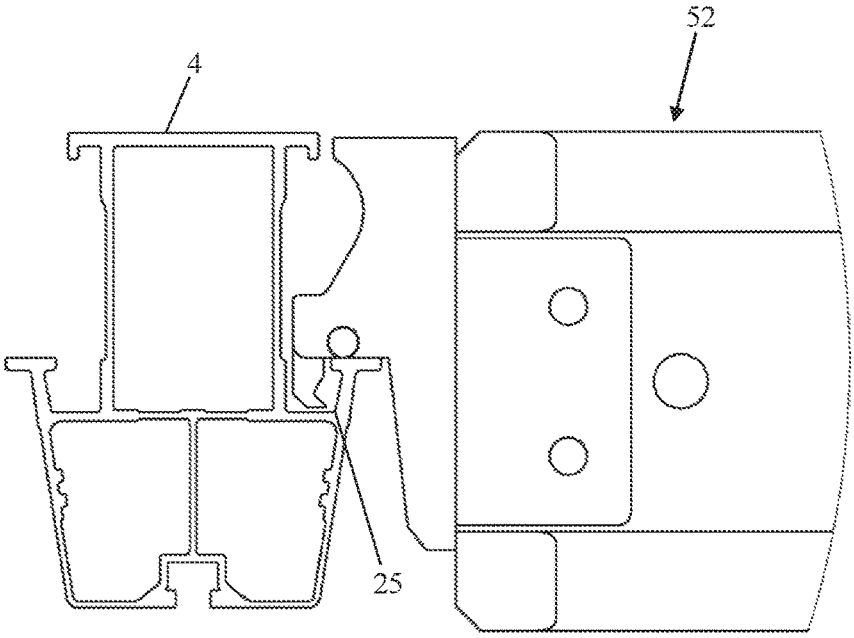

As can be seen from FIGS. 52, 53, a double-T-profiled transverse beam 52 may be used in formwork support system 1. The end region of double-T-profiled transverse beam 52 is formed as in transverse beam 5 described above so that double-T-profiled transverse beam 52 may be hooked into slot 25 of longitudinal beam 4 as explained above. As a matter of course, a conventional double-T-profiled beam having an appropriate shoe (with hooking means able to be received by the slot 25 and a bolt to support the conventional beam on the flange 43 of the longitudinal beam 4) releasably or non-releasably mounted on its ends, of any other shape as shown in FIG. 52, 53, may be used.

Figure 54:
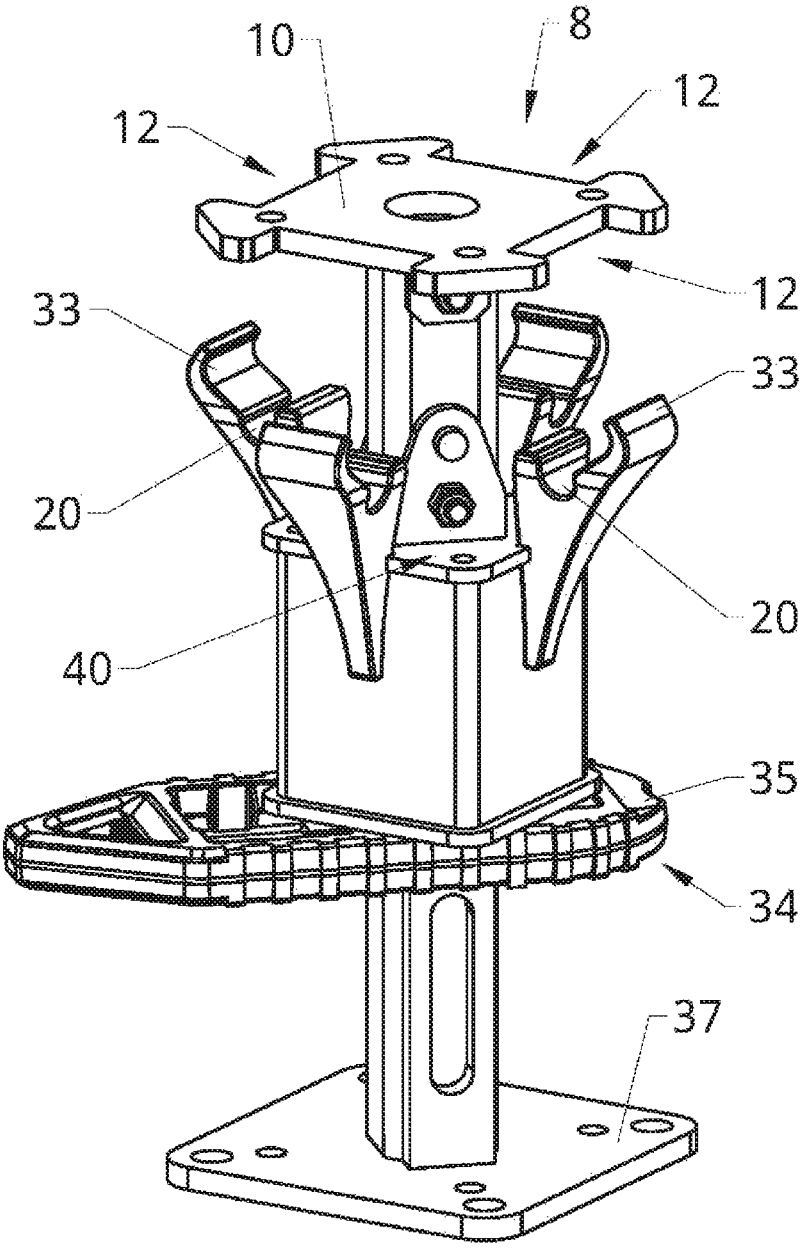
FIGS. 54, 55 and 56 show views of components of another embodiment of a formwork support system.
Figure 55:
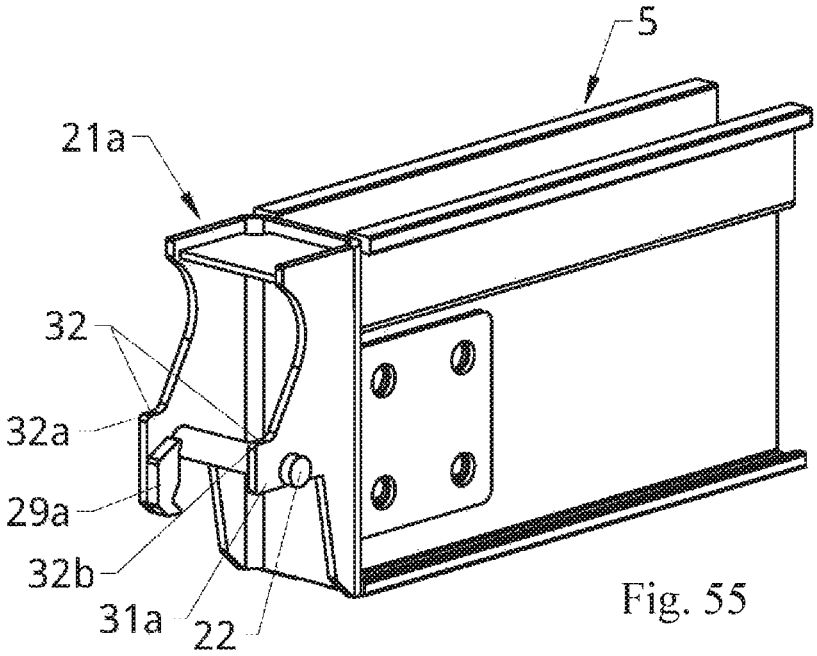
Figure 56:
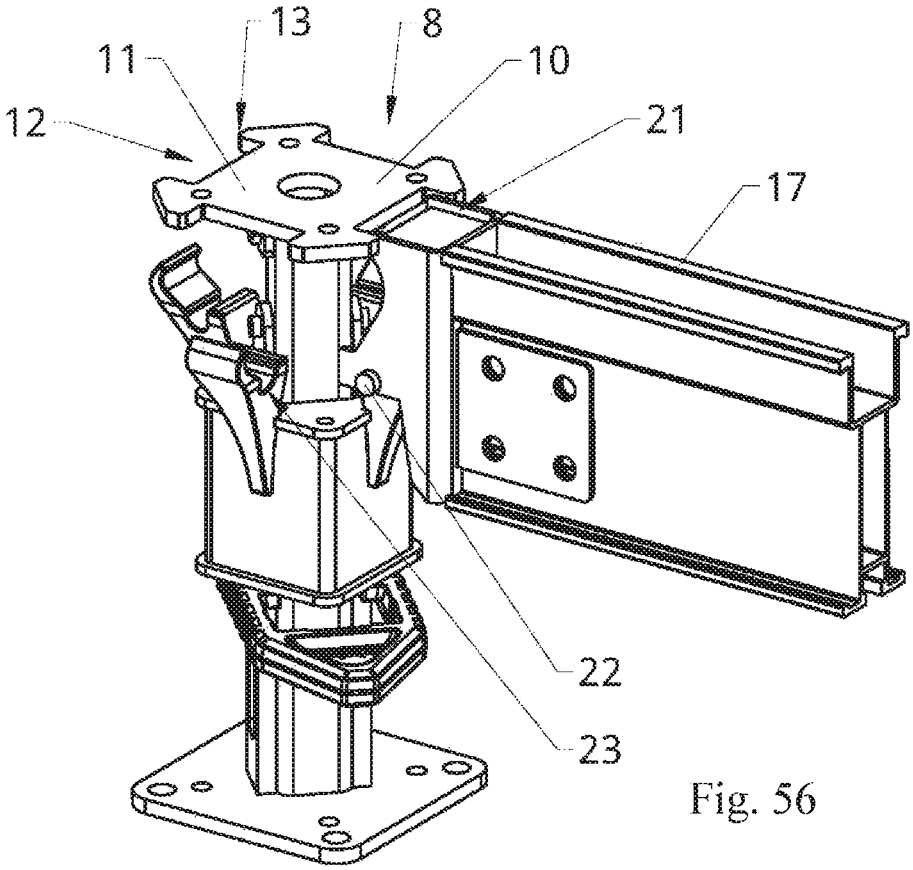

FIGS. 54 to 56 show another embodiment of the head member 8 and end region 21 of the transverse beam 5. The same reference numbers are used for identical or functionally identical parts. In distinction from the embodiment of FIG. 5 and FIG. 6, in this embodiment the head member 8 at each side comprises but one upwardly projecting holding element 33 with a hook formed on its upper free end and a groove 20 or channel 23 for receiving the pin 19 of the longitudinal beam 4 or the bolt 22 of the transverse beam 5. The holding elements 33 as well as the grooves 20 or channels 23 are positioned centrally on each of four sides of a main body of the head member 8. The holding elements 33 are aligned with the recesses 12 of the support plate 10. According to the embodiment of FIG. 5, 6, two holding elements 33 are arranged at lateral edges on each side of the main body of the head member 8. It is apparent, that longitudinal beam 4 when attached to the alternative head member 8 of FIG. 54, 56 shows the same (end) configuration in the same manner as transverse beam 5, in that the edge portion 14, in particular its hook elements 24, of the longitudinal beam 4 are arranged outside holding elements 33.

As can be seen from FIG. 56, the catch element 29 and the abutment element 31 of the end region 21 of the transverse beam 5 are—when connected to the head member 8—arranged outside the groove 20 (or channel 23) formed in the holding element 33. Therefore, the bolt 22 of the end region 21 of the transverse beam 5 may be shorter in length as compared to the embodiment shown in FIG. 8; the catch element 29 of the end region 21 of the transverse beam 5 (FIG. 55) may be smaller in width (FIG. 55). Since the end region 21 is received in the recess 12 of the support plate 10, sideward tilting of the beam 5 is prevented.

It is apparent to the person skilled in the art that multiples of the constituting elements of the formwork support system 1 described herein may be used to cover wider areas of a construction site and/or increase stability of the formwork support system. For example, a greater number of support props 3, longitudinal beams 4 and transverse beams 5 may be deployed.

The invention claimed is:

1. A method of installing a formwork support system, comprising the steps of:

a. arranging a first pair of support props in an upright position, the support props having head members, b. connecting two opposite ends of a first longitudinal beam to the head members of the first pair of support props, c. arranging a second longitudinal beam in an interim mounting position by releasably connecting a first end of the second longitudinal beam to the first longitudinal beam, the second longitudinal beam, in the interim mounting position, freely projecting downwardly from the first end towards a second end, a stop element at the first end of the second longitudinal beam, in the interim mounting position, bearing against the first longitudinal beam, a hook element of the second longitudinal beam, in the interim mounting position, engaging a slot of the first longitudinal beam, d. arranging the second longitudinal beam in a horizontal support position by lifting the second end of the second longitudinal beam.

2. The method according to claim 1, wherein the hook element extends downwardly at the first end of the second longitudinal beam.

3. The method according to claim 1, wherein the hook element of the second longitudinal beam, in the interim mounting position, engages an undercut of a flange delimiting the slot of the first longitudinal beam.

4. The method according to claim 3, wherein the second longitudinal beam, at its first end, has a pin, the pin being supported on a top side of the flange of the first longitudinal beam in the horizontal support position of the second longitudinal beam.

5. The method according claim 1, wherein the slot of the first longitudinal beam extends in a longitudinal direction of the first longitudinal beam at a lateral side thereof.

6. The method according to claim 5, wherein the slot extends over an entire length of a main section of the first longitudinal beam, the main section extending between a first end and a second end of the first longitudinal beam.

7. The method according to claim 1, wherein the second end of the second longitudinal beam is connected to a third longitudinal beam.

8. The method according to claim 1, wherein the hook element of the second longitudinal beam, in the horizontal support position, is accommodated inside the slot of the first longitudinal beam, the hook element being released from its engagement with the slot of the first longitudinal beam.

* * * * *